US010790564B2

(12) United States Patent
Tkadlec et al.

(10) Patent No.: US 10,790,564 B2
(45) Date of Patent: Sep. 29, 2020

(54) TUBULAR IN-LINE FILTERS THAT ARE SUITABLE FOR CELLULAR APPLICATIONS AND RELATED METHODS

(71) Applicant: CommScope Italy S.r.l., Agrate Brianza (IT)

(72) Inventors: Roman Tkadlec, Valasske Klobouky (CZ); Stefano Tamiazzo, Milan (IT)

(73) Assignee: CommScope Italy, S.r.l., Agrate Brianza (MB) (IT)

( * ) Notice: Subject to any disclaimer, the term of this patent is extended or adjusted under 35 U.S.C. 154(b) by 8 days.

(21) Appl. No.: 16/095,219

(22) PCT Filed: Jul. 7, 2017

(86) PCT No.: PCT/US2017/041012

§ 371 (c)(1),
(2) Date: Oct. 19, 2018

(87) PCT Pub. No.: WO2018/017337

PCT Pub. Date: Jan. 25, 2018

(65) Prior Publication Data

US 2019/0140334 A1 May 9, 2019

Related U.S. Application Data

(60) Provisional application No. 62/363,509, filed on Jul. 18, 2016.

(51) Int. Cl.
*H01P 1/202* (2006.01)
*H01P 1/208* (2006.01)
(Continued)

(52) U.S. Cl.
CPC ..... *H01P 1/202* (2013.01); *H01P 1/02* (2013.01); *H01P 1/062* (2013.01); *H01P 1/208* (2013.01); *H01P 5/085* (2013.01); *H01P 7/04* (2013.01)

(58) Field of Classification Search
CPC ..... H01P 1/20; H01P 1/202; H01P 1/208
(Continued)

(56) References Cited

U.S. PATENT DOCUMENTS 3,093,803 A 6/1963 Schlicke et al.
4,553,060 A 11/1985 Domino et al.
(Continued)

FOREIGN PATENT DOCUMENTS

CN 1691404 11/2005
DE 3047466 A1 7/1982
(Continued)

OTHER PUBLICATIONS

International Search Report and Written Opinion of the International Searching Authority, International Application No. PCT/US2017/041012, dated Nov. 2, 2017, 12 pp.
(Continued)

*Primary Examiner* — Rakesh B Patel
(74) *Attorney, Agent, or Firm* — Myers Bigel, P.A.

(57) ABSTRACT

In-line filters may include a tubular metallic housing defining a single inner cavity that extends along a longitudinal axis and a plurality of resonators that are spaced apart along the longitudinal axis within the single inner cavity, each resonator having a stalk. The stalks of first and second of the resonators that are adjacent each other are rotated to have different angular orientations.

20 Claims, 28 Drawing Sheets

(51) Int. Cl.

| | |
|---|---|
| ***H01P 1/02*** | (2006.01) |
| ***H01P 1/06*** | (2006.01) |
| ***H01P 5/08*** | (2006.01) |
| ***H01P 7/04*** | (2006.01) |

(58) Field of Classification Search
USPC ..... 333/209, 212
See application file for complete search history.

(56) References Cited

U.S. PATENT DOCUMENTS

| | | | | |
|---|---|---|---|---|
| 5,012,210 | A | 4/1991 | Marconi et al. | |
| 5,083,102 | A | 1/1992 | Zaki | |
| 5,812,036 | A | 9/1998 | Estrada | |
| 5,886,594 | A | 3/1999 | Guglielmi et al. | |
| 6,323,430 | B1 | 11/2001 | Finona | |
| 6,359,533 | B1 | 3/2002 | Merlock et al. | |
| 2009/0002103 | A1* | 1/2009 | Brand | H01P 1/202 333/207 |
| 2011/0025433 | A1 | 2/2011 | Yu et al. | |
| 2011/0226913 | A1 | 9/2011 | Feige | |
| 2011/0241801 | A1 | 10/2011 | Subedi | |
| 2012/0235877 | A1 | 9/2012 | Beaudin et al. | |
| 2013/0112477 | A1* | 5/2013 | Lorenz | H01P 1/202 174/99 R |

FOREIGN PATENT DOCUMENTS

| | | | |
|---|---|---|---|
| EP | 0375016 | | 6/1990 |
| GB | 2478983 | A | 9/2011 |
| SU | 1479978 | | 5/1989 |
| WO | 01/11711 | A1 | 2/2001 |
| WO | 2016/096168 | A1 | 6/2016 |

OTHER PUBLICATIONS

Wang, H. et al., "An Inline Coaxial Quasi-Elliptic Filter With Controllable Mixed Electric and Magnetic Coupling", IEEE Transactions on Microwave Theory and Techniques, vol. 57, No. 3, Mar. 2009, pp. 667-673.

EMWORKS, "Dual Mode Circular Waveguide Filter", retrieved Jul. 12, 2016 from https://www.emworks.com/application/preview/67/Dual-Mode-Circular-Waveguide-Filter, 3 pp.

Notification Concerning Transmittal of International Preliminary Report on Patentability, for corresponding International Application No. PCT/US2017/065801; dated Jul. 4, 2019.

Extended European Search Report, corresponding to European Application No. 17831562.8, dated Jan. 30, 2020, 9 pgs.

Translation of First Office Action for corresponding Chinese Patent Application No. 201780051166.8 dated Oct. 18, 2019, 10 pages.

* cited by examiner 70
72
74
76
76
76

TUBULAR IN-LINE FILTERS THAT ARE SUITABLE FOR CELLULAR APPLICATIONS AND RELATED METHODS

CROSS-REFERENCE TO RELATED APPLICATIONS

The present application is a 35 U.S.C. § 371 national stage application of PCT Application No. PCT/US2017/041012, filed on Jul. 7, 2017, which itself claims priority to U.S. Provisional Patent Application No. 62/363,509, filed Jul. 18, 2016, the contents of both of which are incorporated herein as if set forth in their entireties. The above-referenced PCT Application was published in the English language as International Publication No. WO 2018/017337 A1 on Jan. 25, 2018.

FIELD OF THE INVENTION

The present invention relates generally to communications systems and, more particularly, to filters that are suitable for use in cellular communications systems.

BACKGROUND

Filters are well known devices that selectively pass signals based on the frequency of the signal. Various different types of filters are used in cellular communications systems. Moreover, as new generations of cellular communications services have been introduced—typically without phasing out existing cellular communications services—both the number and types of filters that are used has expanded significantly. Filters may be used, for example, to allow radio frequency ("RF") signals in different frequency bands to share certain components of a cellular communications system and/or to separate RF data signals from power and/or control signals. As the number of filters used in a typical cellular communications system has proliferated, the need for smaller, lighter and/or less expensive filters has increased.

Conventionally, metal resonant cavity filters have been used to implement many of the filters used in cellular communications systems. As shown in FIG. 1A, in its simplest form, a metal resonant cavity filter 10 may consist of a metallic housing 12 that has walls 14 formed therein that define a row of cavities 18-1 through 18-4. While the example filter 10 illustrated in FIG. 1A includes a total of four cavities 18, it will be appreciated that any appropriate number of cavities 18 may be provided as necessary to provide a filter having desired filtering characteristics. Note that herein when multiple of the same elements or structures are provided, they may be referred to in some instances using two part reference numerals, where the two parts are separated by a dash. Herein, such elements may be referred to individually by their full reference numeral (e.g., cavity 18-2) and may be referred to collectively by the first part of the applicable reference numeral (e.g., the cavities 18).

Still referring to FIG. 1A, a coaxial resonating element or "resonator" 20-1 through 20-4 may be provided in each of the respective cavities 18-1 through 18-4. The walls 14 may include openings or "windows" 16 that allow resonators 20 in adjacent ones of the cavities 18 to couple to each other along a main coupling path that extends from an input 22 to an output 24 of the filter 10. These coupled resonances may form a filter having a pass-band response with no transmission zeros and narrow to moderate fractional bandwidth (e.g., a bandwidth of up to 10-20% of the center frequency of the pass-band, depending on the specific geometry and size of the cavities and resonators).

When wider bandwidths are required it is possible to invert the orientation of every other coaxial resonator 20. A filter 30 having this configuration is shown in FIG. 1B. In filter 30, the electric and magnetic components of the couplings between adjacent resonators 20 add in phase, and hence the total amount of coupling can be increased. As the bandwidth of a filter is proportional to the total amount of coupling, the filter 30 of FIG. 1B may have increased bandwidth as compared to filter 10 of FIG. 1A.

The "response" of a filter refers to a plot of the energy that passes from a first port (e.g., an input port) of the filter to a second port (e.g., an output port) of the filter as a function of frequency. A filter response will typically include one or more pass-bands, which are frequency ranges where the filter passes signals with relatively small amounts of attenuation. A filter response also typically includes one or more stop-bands. A stop-band refers to a frequency range where the filter will substantially not pass signals, usually because the filter is designed to reflect backwards any signals that are incident on the filter in this frequency range. In some applications, it is important that the filter response exhibit a high degree of "local selectivity," meaning that the transition from a pass-band to an adjacent stop-band occurs over a narrow frequency range. One technique for enhancing local selectivity is to add transmission zeros in the filter response. A "transmission zero" refers to a portion of a filter frequency response where the amount of signal that passes is very low. Transmission zeros are typically achieved in one of three ways: (1) by using cross-couplings, (2) by designing resonant couplings or (3) by controlling the anti-resonances of the resonating elements.

Cross-coupling, which is the most common technique used to increase local selectivity in a resonant cavity filter, refers to intentional coupling between the resonating elements of non-adjacent cavities. Depending on the relative location of the transmission zero with respect to the pass-band, the sign of the required cross-coupling might vary. When cross-couplings are used to create transmission zeros, the cavities are often arranged in some form of a planar grid as opposed to the single row of cavities included in the filters 10 and 30 of FIGS. 1A-1B. Such a two-dimensional distribution of cavities facilitates coupling between non-adjacent cavities (i.e., cross-couplings). U.S. Pat. No. 5,812,036 ("the '036 patent"), the contents of which are incorporated herein by reference, discloses various resonant cavity filters that have such two-dimensional cavity arrangements that include cross-coupling.

FIG. 2 of the present application is a top sectional view of a two dimensional resonant cavity filter 40 that is disclosed in the '036 patent. As shown in FIG. 2, the filter 40 includes a total of six cavities 18-1 through 18-6 which each have a respective coaxial resonator 20-1 through 20-6 disposed therein. Coupling windows 16-1 through 16-5 are provided that enable "main" couplings between adjacent ones of the six coaxial resonators 20-1 through 20-6 (i.e., between cavities 18-1 and 18-2, between cavities 18-2 and 18-3, between cavities 18-3 and 18-4, between cavities 18-4 and 18-5, and between cavities 18-5 and 18-6). In addition, the filter 40 includes two bypass coupling windows 26-1, 26-2 that enable cross-coupling between two pairs of non-adjacent resonators (namely, between cavities 18-1 and 18-6 and between cavities 18-2 and 18-5). The main couplings between the five sequential pairs of resonators 20 and the two cross-couplings between the two pairs of non-adjacent resonators 20 contribute to the overall transfer function of the filter 40.

Cross couplings may also be achieved in an in-line (i.e., one dimensional) resonant cavity filter design by including some form of distributed coupling elements to implement the cross couplings. FIG. 3 illustrates a filter 50 that is implemented using this approach. As shown in FIG. 3, the filter 50 is an in-line filter having four cavities 18-1 through 18-4 that have respective coaxial resonators 20-1 through 20-4 mounted therein. Coupling windows 16 are provided that enable "main" couplings between adjacent ones of the four coaxial resonators 20. A distributed coupling element 60 in the form of a direct ohmic connection between coaxial resonator 20-1 and coaxial resonator 20-4 is also provided. The direct ohmic connection 60 may physically and electrically connect resonator 20-1 to resonator 20-4 without physically or electrically connecting to any of the intervening resonators (namely resonators 20-2 or 20-3 in this example). The use of the distributed coupling element 60 may, however, have various disadvantages including increased filter size, complexity and cost, susceptibility to damage, increased losses and/or reduced out-of-band attenuation.

In-line resonant cavity filters having cross couplings may also be realized without use of a distributed coupling element by providing some form of controlled mixed coupling between adjacent resonators so that the spurious (cross) couplings between non-adjacent resonators can be controlled to some extent. Such an approach is disclosed in U.S. Provisional Patent Application Ser. No. 62/091,696, filed Dec. 15, 2014 ("the '696 application"), the entire content of which is incorporated herein by reference. FIG. 4 is a schematic cross-sectional view of a filter 70 which is one of the filters disclosed in the '696 application.

As shown in FIG. 4, the filter 70 includes a metallic housing 12 that has a single cavity 18 formed therein. A plurality of coaxial resonators 20 are arranged in a row within the cavity 18. The top 72 and bottom 74 surfaces of the housing 12 form respective ground planes. A plurality of tuning screws 76 are provided in the top and bottom surfaces 72, 74 of housing 12 that extend into the cavity 18. Filter 70 further includes four conductive connectors 84, each of which provides a physical (ohmic) connection between respective adjacent pairs of resonators 20. The proximity of the resonators 20 and the absence of shielding walls may result in non-negligible couplings between both adjacent and non-adjacent resonators 20. The couplings will include both capacitive couplings and inductive couplings. The amount of capacitive and inductive coupling is a function of, among other things, the distance between the resonators 20. The amount of capacitive coupling may also be controlled by adjusting the length and or width of the upper part of each resonator 20 to generate more or less capacitive coupling between different resonators 20. Capacitive coupling between adjacent resonators 20 will result in negative coupling values. Inductive coupling can be controlled by changing the distance between the resonators 20 and/or by adjusting the length of the lower part of each resonator 20 that connects to the bottom surface 74 of the housing 12. The inductive coupling results in positive coupling between both adjacent and non-adjacent resonators 20. Because the filter 70 is designed to have non-negligible inductive coupling between non-adjacent resonators 20, cross-coupling may be achieved in the filter 70 without employing discrete bypass connectors that ohmically connect non-adjacent resonators 20. The sign of the main couplings may be positive or negative depending upon the relative amounts of capacitive versus inductive coupling, while the signs of the cross-couplings are always positive.

The second technique that may be used for generating transmission zeros is the use of resonant couplings. Transmission zeros may occur at frequencies where the capacitive couplings cancel out the inductive couplings. Such resonant couplings are usually avoided in ordinary pass-band filters design, as it is typically desirable to have couplings with a constant intensity over the operational frequency range of the filter.

The third technique that may be used for generating transmission zeros is controlling the anti-resonances of the resonating elements. Anti-resonances are frequencies where cavities of the filter reflect incoming power back to the source. This is the dual behavior of the resonances, where the cavity transmits to the load all of the incoming power. To control the anti-resonant (together with the resonant) frequencies, a cavity of the filter that has a certain geometry is defined and then allowed to interact with the adjacent cavities only at one suitable location. Except for this interaction point, the cavity is electrically and mechanically isolated by means of metal walls from the adjacent cavity.

SUMMARY

Pursuant to embodiments of the present invention, an in-line filter is provided that includes a tubular metallic housing defining a single inner cavity that extends along a longitudinal axis and a plurality of resonators that are spaced apart along the longitudinal axis within the single inner cavity, each resonator having a conductive stalk oriented transverse to the longitudinal axis. The stalks of first and second of the resonators that are adjacent each other are rotated to have different angular orientations about the longitudinal axis.

In some embodiments, each resonator includes a first capacitive loading element that extends from a first end portion of the stalk of the respective resonator. The first capacitive loading element may be a first arc-shaped arm. Each resonator may comprise a second arc-shaped arm that extends from a second end portion of the stalk that is opposite the first end portion.

In some embodiments, the in-line filter may further include a transmission line that extends between at least two of the resonators, where each of the at least two resonators capacitively coupled to the transmission line.

In some embodiments, the in-line filter may further include an input connector and an output connector that are coupled to the tubular metallic housing. The transmission line may electrically connect the input connector to the output connector.

In some embodiments, the in-line filter may further include a tubular dielectric frame within the tubular metallic housing. The transmission line may be on an outer surface of the tubular dielectric frame.

In some embodiments, each resonator includes a first arc-shaped capacitive loading element that extends from a first end portion of the stalk of the resonator, and wherein the stalks of the resonators extend through the tubular dielectric frame and the first arc-shaped capacitive loading elements are on the outer surface of the tubular dielectric frame, with the transmission line positioned between each first arc-shaped capacitive loading element and the tubular dielectric frame. The in-line filter may further include a tuning element that is configured to bend the first arc-shaped capacitive loading element of the first resonator closer to the transmission line In some embodiments, the tubular metallic housing is grounded, and each resonator is electrically floating.

In some embodiments, each resonator further includes a plurality of spacers that space the first and second arc-shaped arms apart from an inner surface of the tubular metallic housing.

In some embodiments, the resonators include at least a first resonator, a second resonator that is adjacent the first resonator, and a third resonator that is adjacent the second resonator, wherein the stalks of the first and third resonators have substantially the same angular orientation. In such embodiments, the stalk of the second resonator may be rotated to have an angular orientation that is offset by approximately ninety degrees from the angular orientations of the stalks of the first and third resonators.

In some embodiments, the tubular metallic housing has a substantially circular cross-section.

In some embodiments, the filter comprises a band stop filter. In other embodiments, the filter comprises a bandpass filter, and the filter does not include any distributed coupling elements for coupling between non-adjacent resonators.

Pursuant to further embodiments of the present invention, a filter is provided that includes an electrically grounded tubular metallic housing defining a single inner cavity, a plurality of electrically floating resonators that are disposed in a spaced-apart arrangement within the single inner cavity, and a transmission line that extends from an input to an output of the filter, the transmission line capacitively coupled to at least some of the resonators.

In some embodiments, each resonator includes a stalk and a first capacitive loading element that extends from an end portion of the stalk.

In some embodiments, each first capacitive loading element comprises a first arc-shaped arm.

In some embodiments, each resonator comprises a second arc-shaped arm that extends from a second end portion of the stalk that is opposite the first end portion.

In some embodiments, the transmission line is capacitively coupled to the first capacitive loading element of each of the resonators.

In some embodiments, the filter further includes an input coaxial connector and an output coaxial connector that are coupled to the tubular metallic housing.

In some embodiments, the transmission line electrically connects an inner conductor of the input connector to an inner conductor of the output connector.

In some embodiments, the filter further includes a tubular dielectric frame within the tubular metallic housing, wherein the transmission line is on an outer surface of the tubular dielectric frame and where the stalk of each resonator extends through the tubular dielectric frame and the first and second arc-shaped arms are on the outer surface of the tubular dielectric frame, with the transmission line positioned between each first arc-shaped arm and the tubular dielectric frame.

In some embodiments, wherein each resonator further includes a plurality of spacers that space the first and second arc-shaped arms apart from an inner surface of the tubular metallic housing.

In some embodiments, the resonators include at least a first resonator, a second resonator that is adjacent the first resonator and a third resonator that is adjacent the second resonator, wherein the stalks of the first and second resonators are rotated to have different angular orientations.

In some embodiments, the first and third resonators have substantially the same angular orientations.

In some embodiments, the tubular metallic housing has a substantially circular cross-section.

Pursuant to still further embodiments of the present invention, a coaxial patch cord is provided that includes (1) a coaxial cable that has an inner conductor, an outer conductor that circumferentially surrounds the inner conductor, a dielectric space between the inner conductor and the outer conductor and a jacket surrounding the outer conductor, (2) a first coaxial connector on a first end of the coaxial cable, (3) a second coaxial connector and (4) an in-line filter coupled between the coaxial cable and the second coaxial connector.

In some embodiments, the in-line filter may include a tubular metallic housing defining a single inner cavity that extends along a longitudinal axis and a plurality of resonators that are spaced apart along the longitudinal axis within the single inner cavity. Each resonator may have a stalk, and the stalks of first and second of the resonators that are adjacent each other are rotated to have different angular orientations.

In some embodiments, each resonator includes a first capacitive loading element that extends from a first end portion of the stalk.

In some embodiments, each first arm comprises a first arc-shaped arm, and wherein each resonator further comprises a second arc-shaped an that extends from a second end portion of the stalk that is opposite the first end portion.

In some embodiments, the in-line filter may further include a transmission line that extends between at least two of the resonators, each of the at least two resonators capacitively coupled to the transmission line.

In some embodiments, the in-line filter may further include a tuning element that is configured to bend the first capacitive loading element of a first of the resonators closer to the transmission line.

In some embodiments, the in-line filter may further include a tubular dielectric frame within the tubular metallic housing, wherein the transmission line is on an outer surface of the tubular dielectric frame.

In some embodiments, the stalk of each resonator extends through the tubular dielectric frame and the capacitive loading elements are on the outer surface of the tubular dielectric frame, with the transmission line positioned between each capacitive loading element and the tubular dielectric frame.

In some embodiments, the tubular metallic housing is grounded, and wherein each resonator is electrically floating.

In some embodiments, the resonators include at least a first resonator, a second resonator that is adjacent the first resonator and a third resonator that is adjacent the second resonator, wherein the stalks of the first and third resonators have substantially the same angular orientations.

In some embodiments, the tubular metallic housing has a substantially circular cross-section.

In some embodiments, the in-line filter comprises an electrically grounded tubular metallic housing defining a single inner cavity, a plurality of electrically floating resonators that are disposed in a spaced-apart arrangement within the single inner cavity, and a transmission line that extends from an input to an output of the filter, the transmission line capacitively coupled to at least some of the resonators. In such embodiments, each resonator may include a stalk and a first capacitive loading element. Each first capacitive loading element may comprise a first arc-shaped arm that extends from a first end portion of the stalk. Each resonator may comprise a second arc-shaped arm that extends from a second end portion of the stalk that is opposite the first end portion. The transmission line may be capacitively coupled to the first arc-shaped arm of each of the resonators.

In some embodiments, the in-line filter may further include a tubular dielectric frame within the tubular metallic housing, where the transmission line is on an outer surface of the tubular dielectric frame and wherein the stalk of each resonator extends through the tubular dielectric frame and the first and second arc-shaped arms are on the outer surface of the tubular dielectric frame, with the transmission line positioned between each first arc-shaped arm and the tubular dielectric frame.

In some embodiments, each resonator further includes a plurality of spacers that space the first and second arc-shaped arms apart from an inner surface of the tubular metallic housing.

In some embodiments, the resonators include at least a first resonator, a second resonator that is adjacent the first resonator and a third resonator that is adjacent the second resonator, wherein the stalks of the first and second resonators have different angular orientations, and the stalks of the first and third resonators have substantially the same angular orientations.

DETAILED DESCRIPTION

Figure 1A:
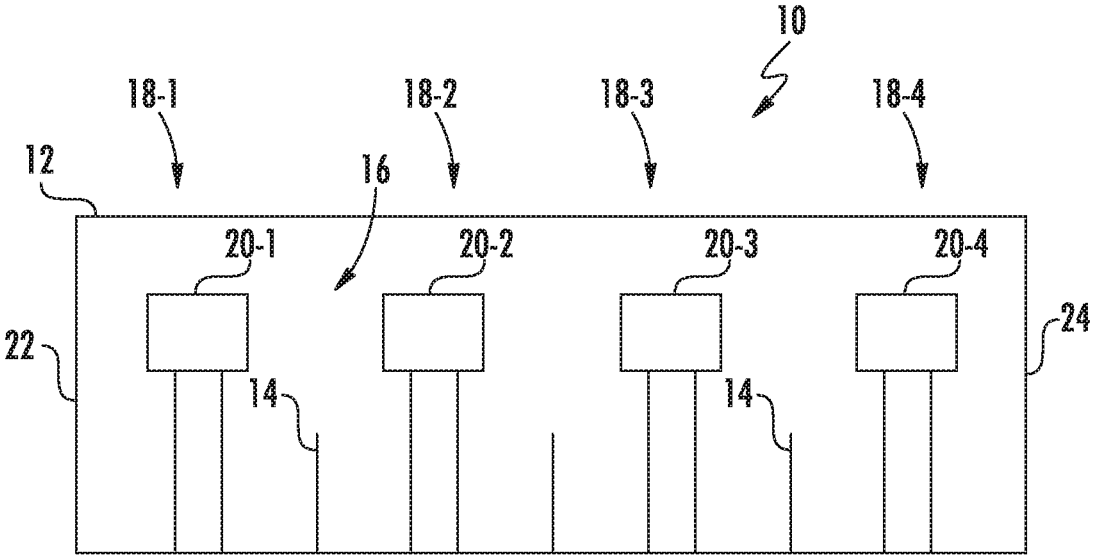
FIG. 1A PRIOR ART
FIG. 1A is a schematic side sectional view of a conventional in-line resonant cavity filter.
Figure 1B:
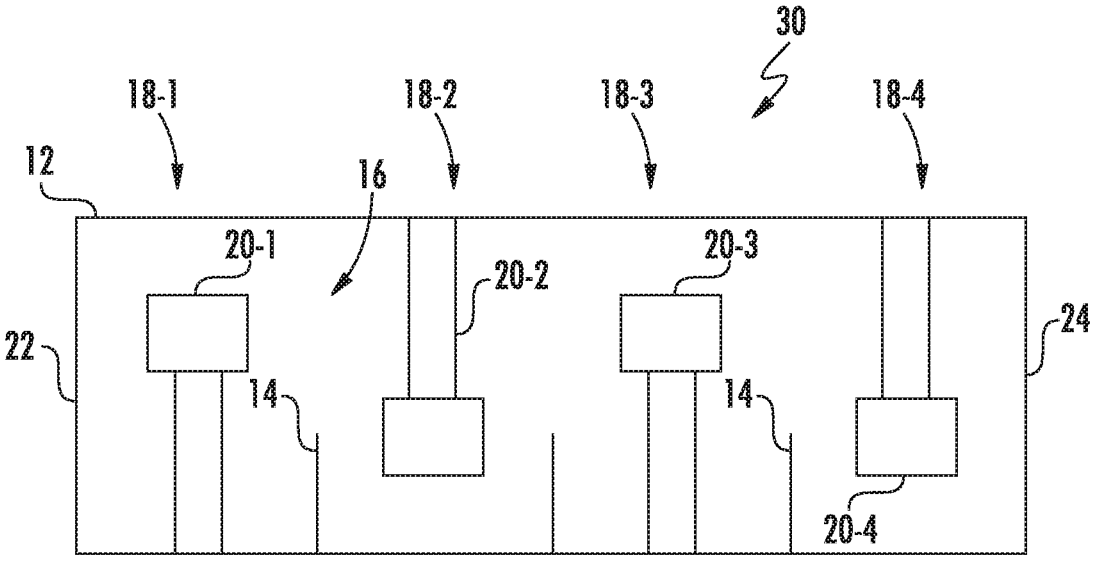
FIG. 1B PRIOR ART
FIG. 1B is a schematic side sectional view of another conventional in-line resonant cavity filter in which every other resonator is inverted.
Figure 2:
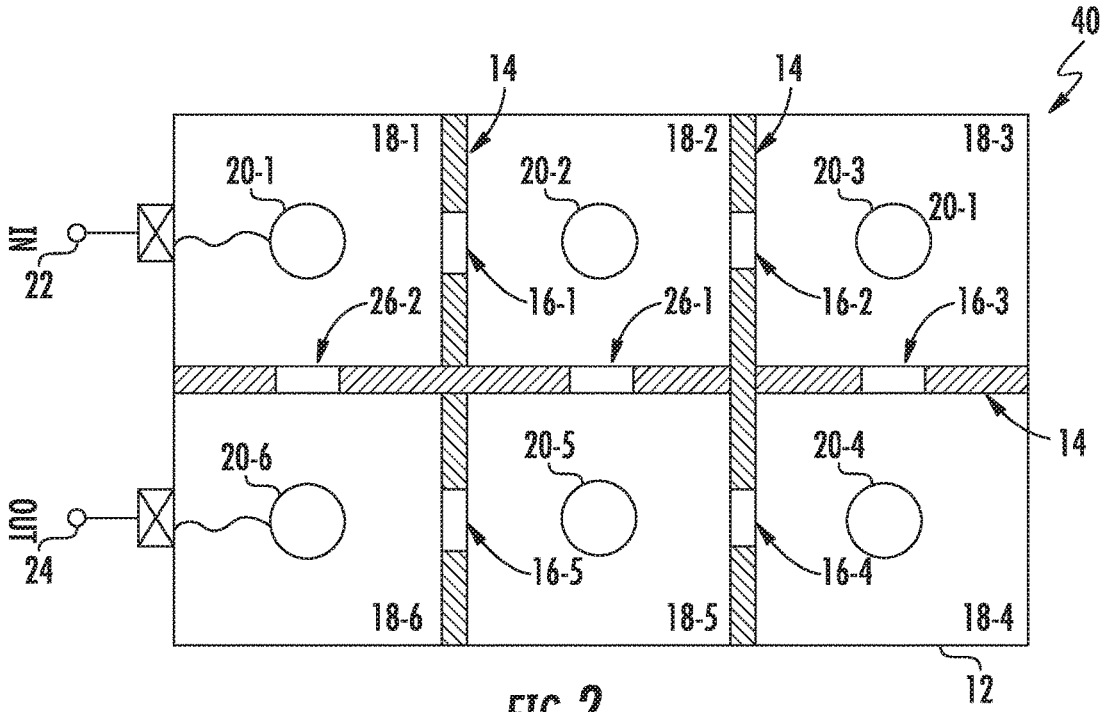
FIG. 2 PRIOR ART
FIG. 2 is a schematic top sectional view of a conventional resonant cavity filter that has cross-coupling between selected cavities.
Figure 3:
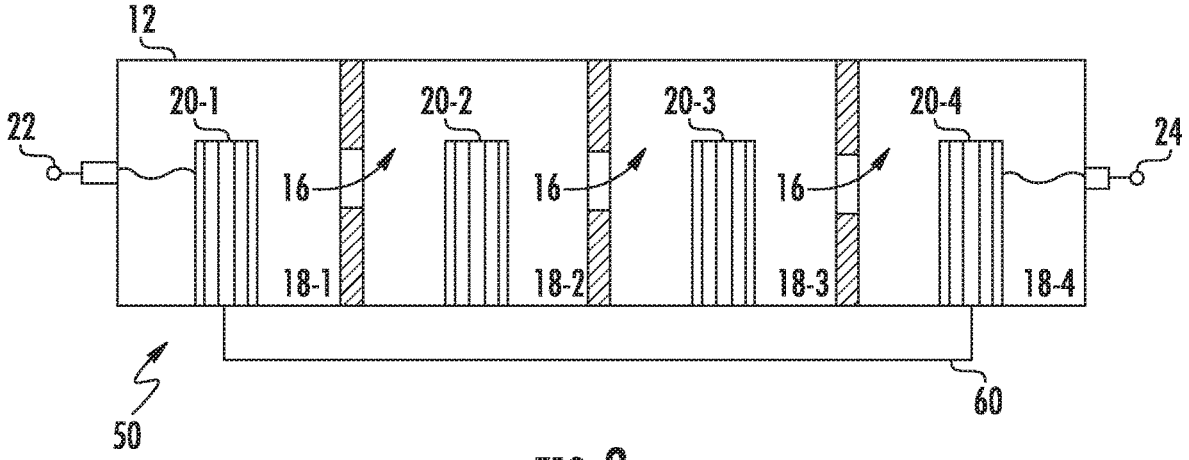
FIG. 3 PRIOR ART
FIG. 3 is a schematic side sectional view of a conventional in-line resonant cavity filter that has an external cross-coupling element.

Pursuant to embodiments of the present invention, filters are provided that include a plurality of resonators accommodated inside a tubular metallic housing such as a cylindrical, rectangular or other shaped metallic tube. In some embodiments, connectors may be provided at either end of the tubular metallic housing to provide an in-line filter that may be inserted along a cabling connect on such as, for example, between a patch cord and a piece of equipment such as a radio, antenna or the like. In other embodiments, the filter may be incorporated into a patch cord, thereby eliminating the need for a stand-alone device and simplifying installation. The resonators can be, for example, half-wavelength or quarter-wavelength metallic resonators. The distances between the resonators and the angular orientation of the stalks of the resonators may be varied to provide different filter responses. A transmission line that extends from the input to the output of the filter may be provided in some embodiments to realize bandstop filter responses or load-source coupling. In other embodiments, the transmission line may be omitted (e.g., to provide a bandpass filter). A wide variety of different types of filters may be formed using the techniques disclosed herein, including bandpass filters (with or without transmission zeros), bandstop filters, diplexers, duplexers, smart bias tees, dual mode resonators and the like. The filters according to embodiments of the present invention may be smaller and lighter weight than many conventional filters that they would replace, and may also be significantly less expensive to manufacture.

In some embodiments, the filter may have a tubular metallic housing that defines a single cavity with a plurality of resonators disposed within the cavity. The metallic housing may be grounded. The cavity may not include any interior walls. Each resonator may include a stalk which may comprise, for example, a central portion of the resonator. The resonators may also include at least one capacitive loading element in some embodiments. The capacitive loading element may comprise, for example, one or more arms that are provided on one or both end portions of the stalk or a head that is provided on an end portion of the stalk. These arms may be configured to capacitively couple with the tubular metallic housing. The relative angular orientations of stalks of the respective resonators may be arranged to achieve a desired coupling between the various resonators in order to achieve a desired filter response. In particular, by changing the relative angular orientations of the stalks, the resonators may be electrically isolated from each other, to the extent desired, without being mechanically isolated from each other. In some embodiments, the resonators may generally extend along a longitudinal axis of the tubular metallic housing, and the angular orientations of the stalks of the resonators may be arranged to couple or isolate resonators from each other. For example, by rotating an orientation of a first resonator ninety degrees with respect to an orientation of a second resonator, the two resonators may be substantially de-coupled. The shapes of the resonators, the distances between the resonators and the relative angular orientations of the resonators may be selected to achieve couplings that provide a desired frequency response for the filter. In some embodiments, a tubular dielectric frame may be provided within the tubular metallic housing, and the stalks of the resonators may extend through the tubular dielectric frame and the arms of the resonators may be between the tubular dielectric frame and the tubular metallic housing.

In some embodiments, the resonators may be held in place within the tubular metallic housing by the spring force of the metallic arms. For example, the resonator arms may be spring loaded against the tubular metallic housing and dielectric spacers may be provided that space the spring-loaded resonator arms away from the tubular metallic housing. In some embodiments, the tubular metallic housing may have a single internal cavity, and all of the resonators may be contained within this single cavity. This may reduce the cost of the filter, as providing internal walls that divide the interior of the housing into multiple separate cavities increases the complexity of the manufacturing process. Additionally, the relative angular orientations of the resonators may differ. The angular orientations of the resonators may be selected to effect the amount that each resonator couples with adjacent and non-adjacent resonators.

In some embodiments, cables such as coaxial patch cords may be provided that have tubular filters according to embodiments of the present invention integrated into the patch cord. In many wireless applications, installers may impose a separate charge for each item of equipment mounted on an antenna tower or other structure. In many cases, various filters such as diplexers, smart bias tees, bandstop filters and the like may be implemented separately from the antennas in order to reduce the size and weight of the antenna. Mounting these separate filters may thus result in additional charges, and local zoning ordinances may also limit the use of such additional components that are external to the radio and antenna. By integrating the filters into the patch cord convections between the radio and the antenna—either as an inline filter or as a filter that is part of the cable—external filters may be provided that comply with the local zoning ordinances and which avoid extra mounting fees.

Embodiments of the present invention will now be described in greater detail with reference to FIGS. 5-19C, in which example embodiments are depicted.

Figure 5:
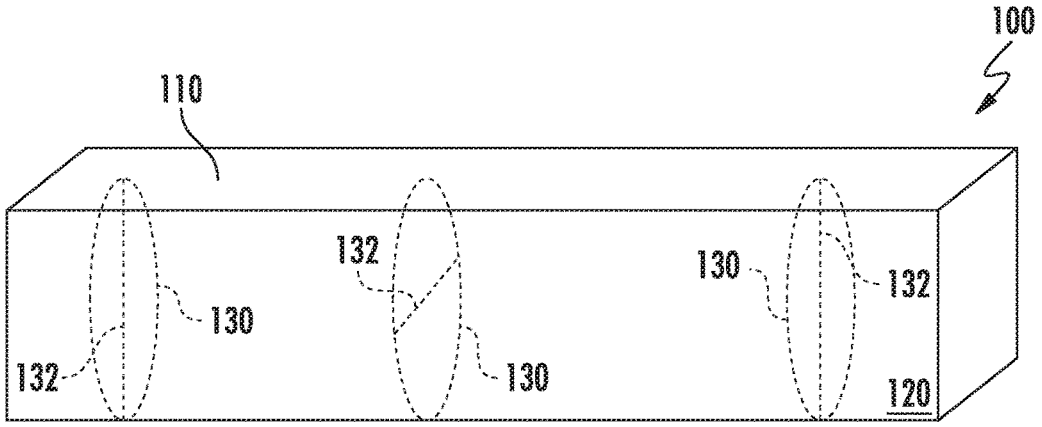
FIG. 5 is a schematic block diagram of a resonant filter according to embodiments of the present invention.

FIG. 5 is a schematic block diagram of a resonant filter 100 according to embodiments of the present invention. As shown in FIG. 5, the filter 100 includes a tubular metallic housing 110 that defines a single inner cavity 120 that extends along a longitudinal axis. A plurality of resonators 130 are spaced apart along the longitudinal axis within the single inner cavity 120. Each resonator has a stalk 132. The stalks 132 of first and second of the resonators 130 that are adjacent each other are rotated to have different angular orientations. The relative angular orientations of the stalks 132 may be selected to achieve desired amounts of coupling between adjacent and non-adjacent ones of the resonators 130 in order to achieve a desired response for the filter 100.

Figure 6:
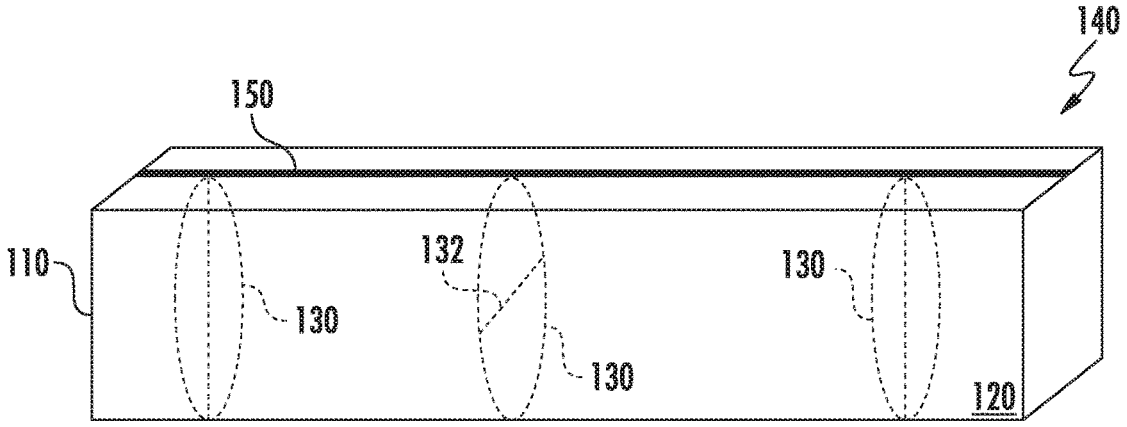
FIG. 6 is a schematic block diagram of a resonant filter according to further embodiments of the present invention.

FIG. 6 is a schematic block diagram of a resonant filter 140 according to further embodiments of the present invention. As shown in FIG. 6, the filter 140, like the filter 100, includes a tubular metallic housing 110 that defines a single inner cavity 120 that extends along a longitudinal axis. The tubular metallic housing 110 may be connected to electrical ground. A plurality of resonators 130 are spaced apart along the longitudinal axis within the single inner cavity 120. In some embodiments, the resonators 130 are not galvanically connected to the tubular metallic housing 110, although they may be in other embodiments. Each resonator 130 may be electrically floating. A transmission line 150 is provided that extends from an input to an output of the filter 140. The transmission line 150 may be coupled to at least some of the resonators 130. In example embodiments, the transmission line 150 may be capacitively coupled to the resonators 130, although other types of coupling may be used in other embodiments (e.g., inductive coupling or even a galvanic connection). The relative angular orientations of the stalks 132 may be selected to achieve desired amounts of coupling between adjacent and non-adjacent ones of the resonators 130 in order to achieve a desired response for the filter 140.

Figure 7:
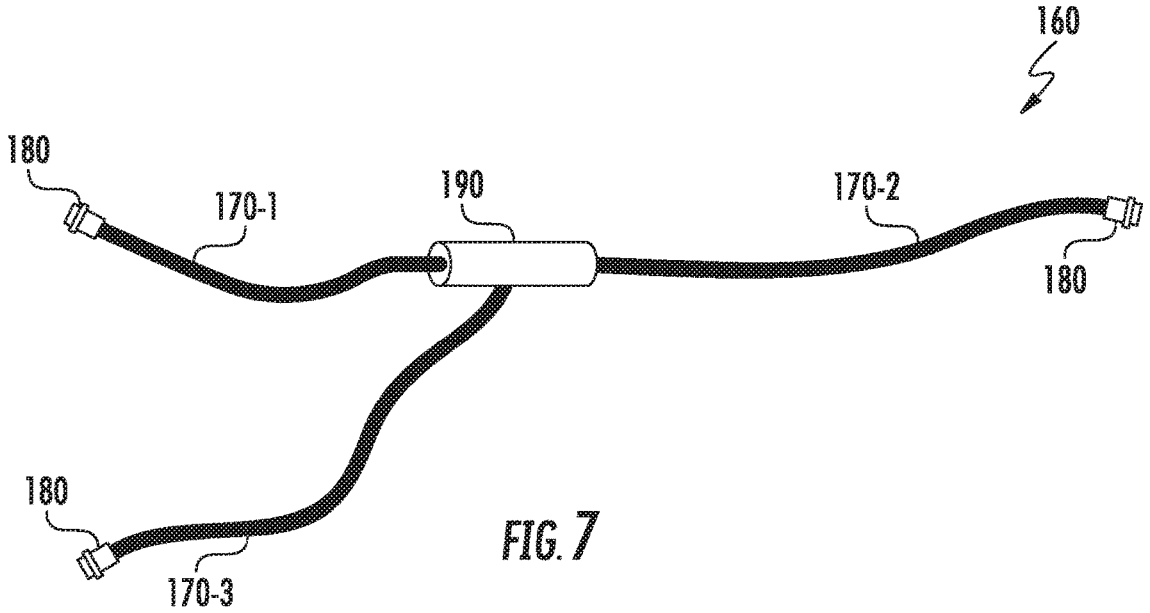
FIG. 7 is a schematic block diagram of a patch cord that includes an integrated filter according to, embodiments of the present invention.

FIG. 7 is a schematic perspective view of a patch cord 160 according to still further embodiments of the present invention. As shown in FIG. 7, the patch cord 160 includes first, second and third coaxial cable segments 170-1, 170-2, 170-3. Each coaxial cable segment 170 may comprise a conventional coaxial cable segment. A coaxial connector 180 may be provide on one end of each coaxial cable segment 170. A filter 190 according to embodiments of the present invention may be connected to the other end of each coaxial cable segment 170. In the depicted embodiment, the filter 190 is a three port device, and hence three coaxial cable segments 170 are included in the patch cord 160. The filter 190 may comprise, for example, a diplexer, a duplexer or a smart bias tee. In other embodiments, the filter 190 may comprise an in-line filter having only two ports. In such embodiments, the coaxial cable segment 170-3 is omitted. In some embodiments, the filter 190 may be provided immediately adjacent one of the connectors 180, which may allow one of the coaxial cable segments 170 to be omitted.

Figure 8A:
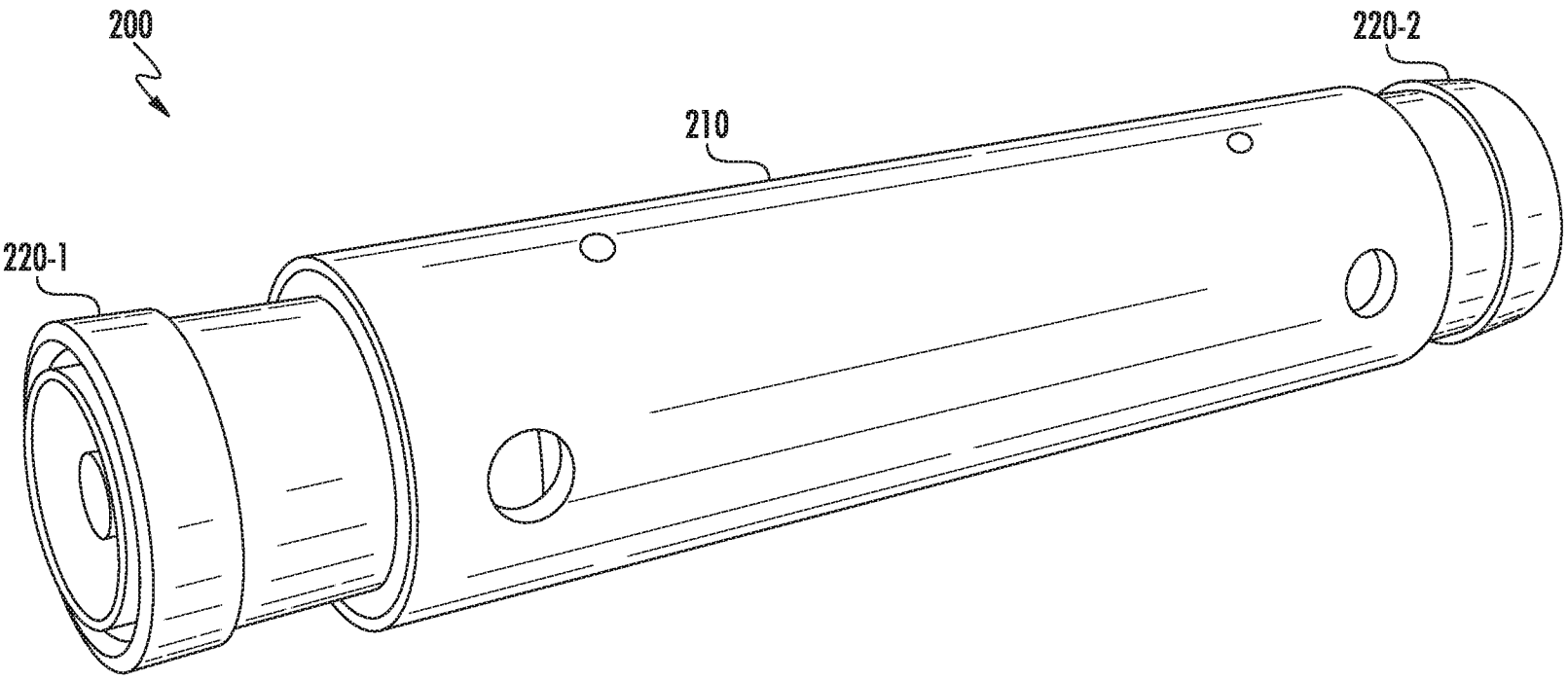
FIG. 8A is a perspective view of a filter according to embodiments of the present invention.
Figure 8B:
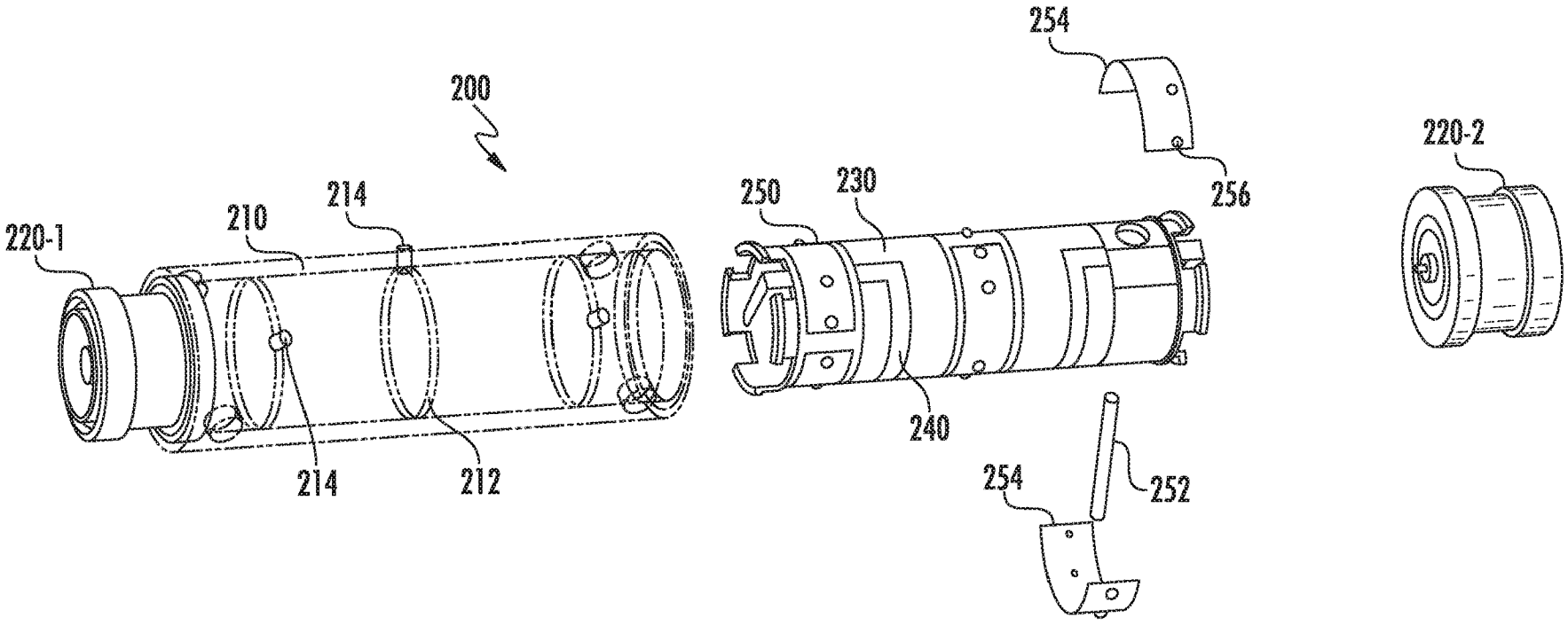
FIG. 8B is an exploded perspective view of the filter of FIG. 8A.
Figure 8C:
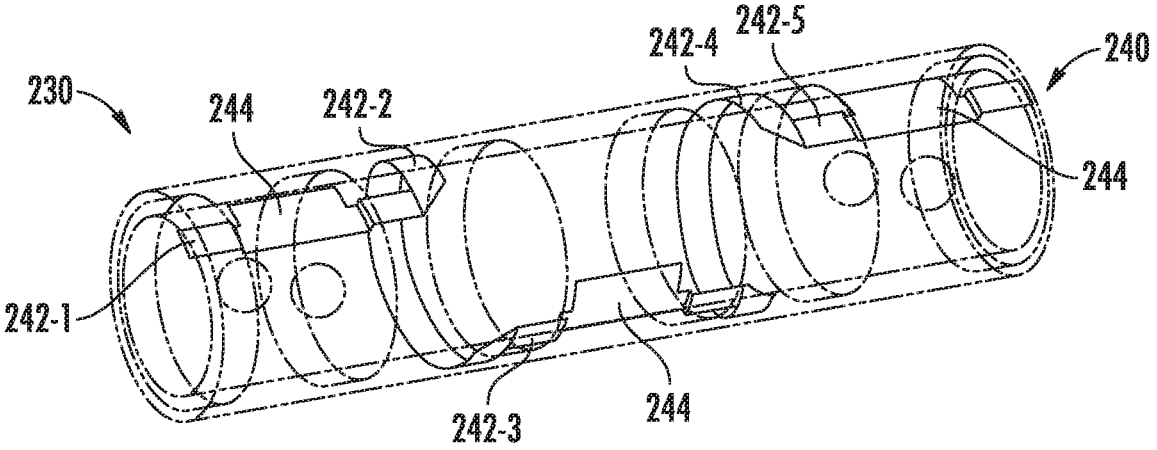
FIG. 8C is a perspective view of a tubular dielectric frame included in the filter of FIG. 8A that has a microstrip transmission line formed thereon.
Figure 8D:
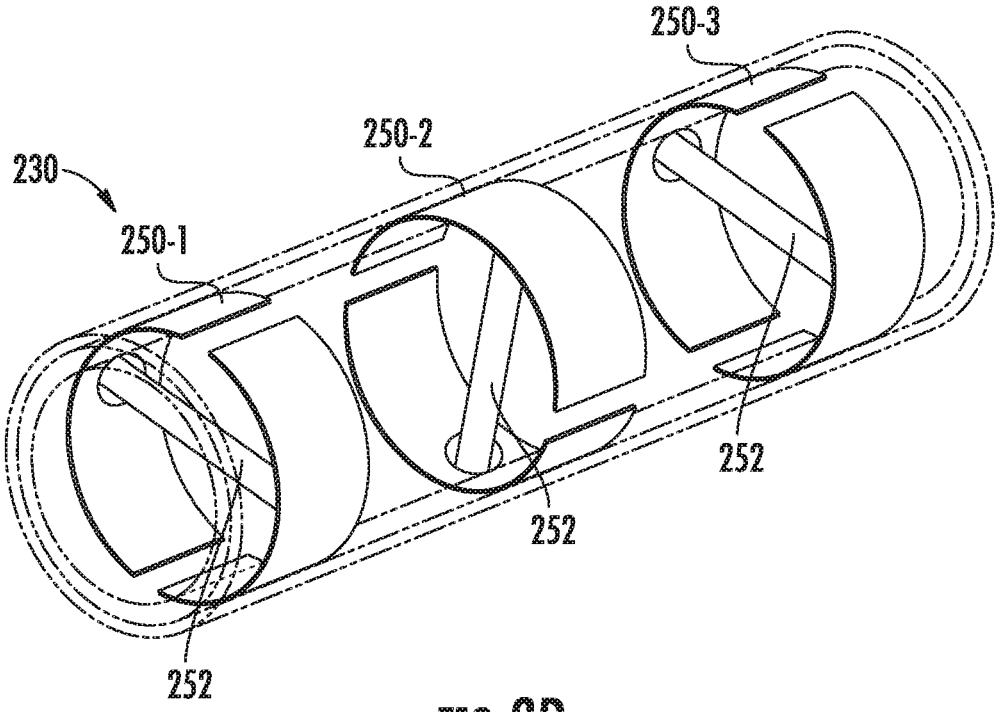
FIG. 8D is a perspective view of the tubular dielectric frame of FIG. 8C with three resonators mounted thereon.
Figure 8E:
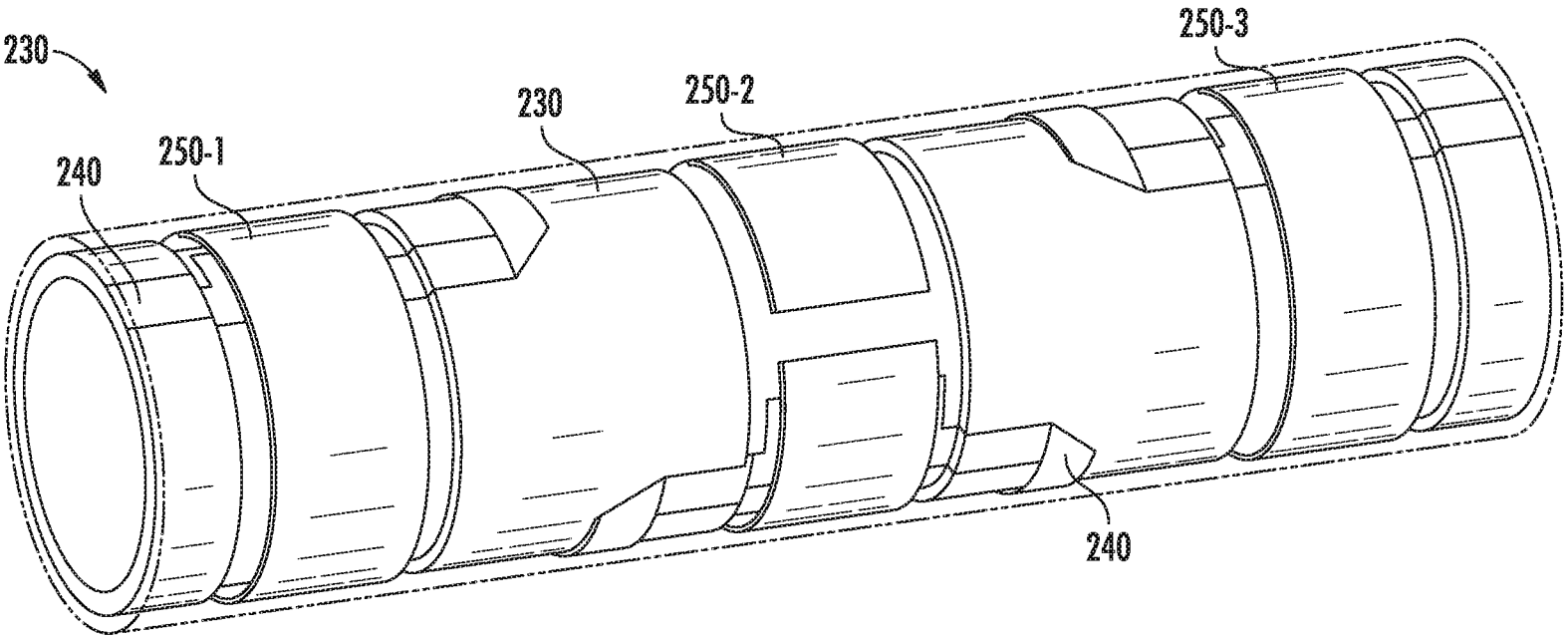
FIG. 8E is a perspective view of the tubular dielectric frame of FIG. 8C with both the microstrip transmission line and the resonators mounted thereon.
Figure 8F:
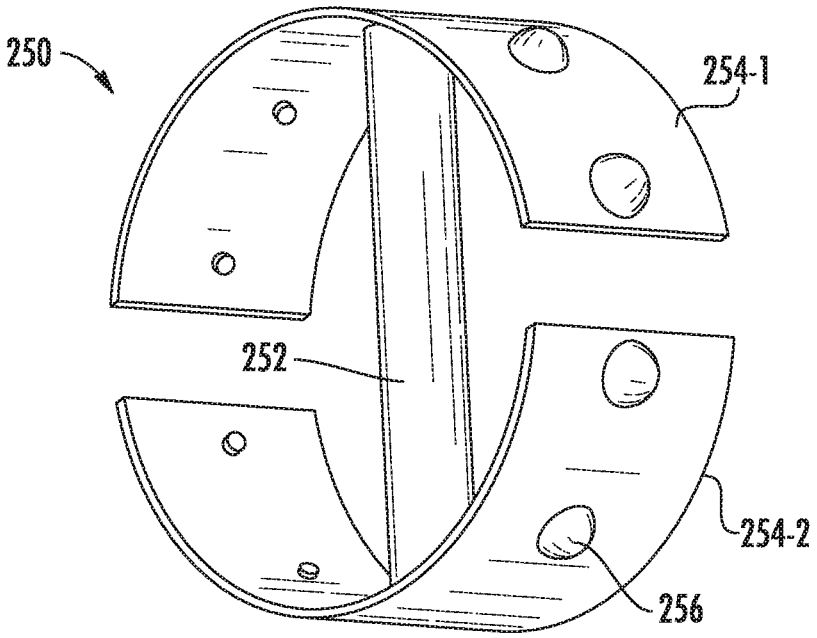
FIG. 8F is a perspective view of one of the resonators of FIG. 8D.
Figure 8G:
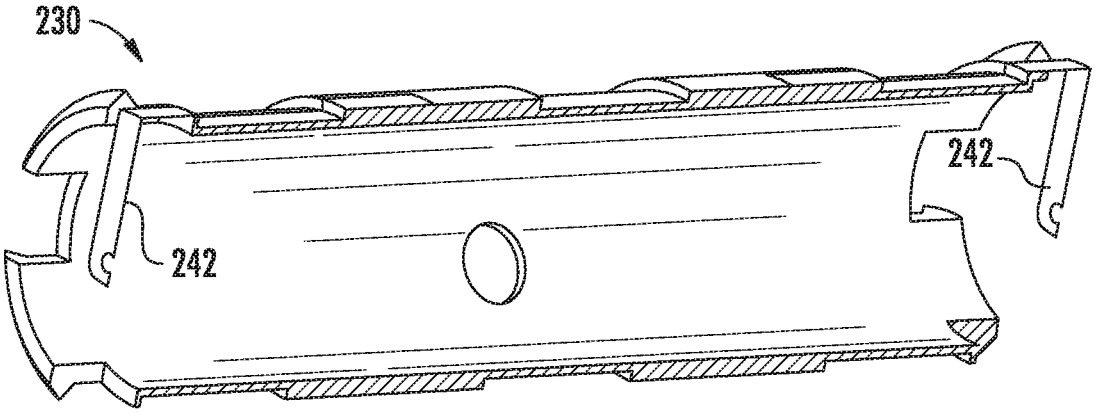
FIG. 8G is a perspective sectional view of the tubular dielectric frame of FIG. 8C.
Figure 8H:
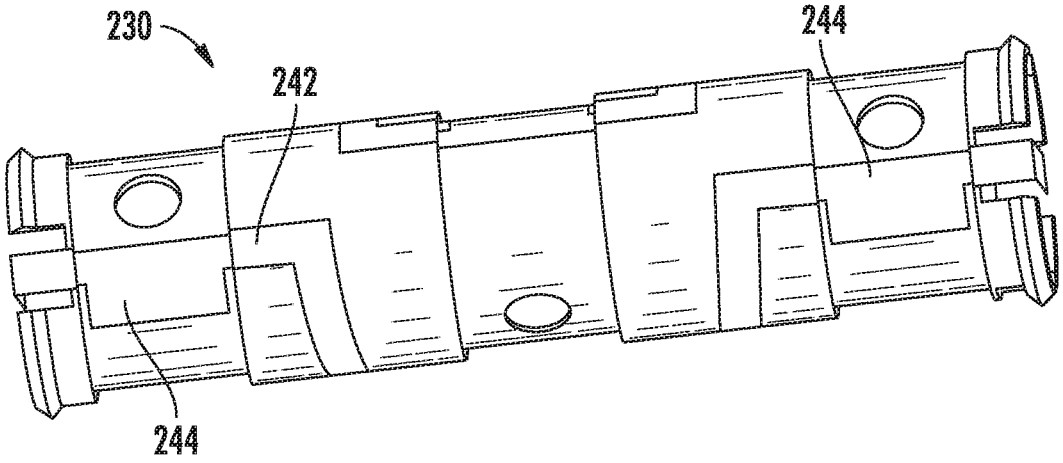
FIG. 8H is a perspective view of the tubular dielectric frame of FIG. 8C with the microstrip transmission line mounted thereon.
Figure 8I:
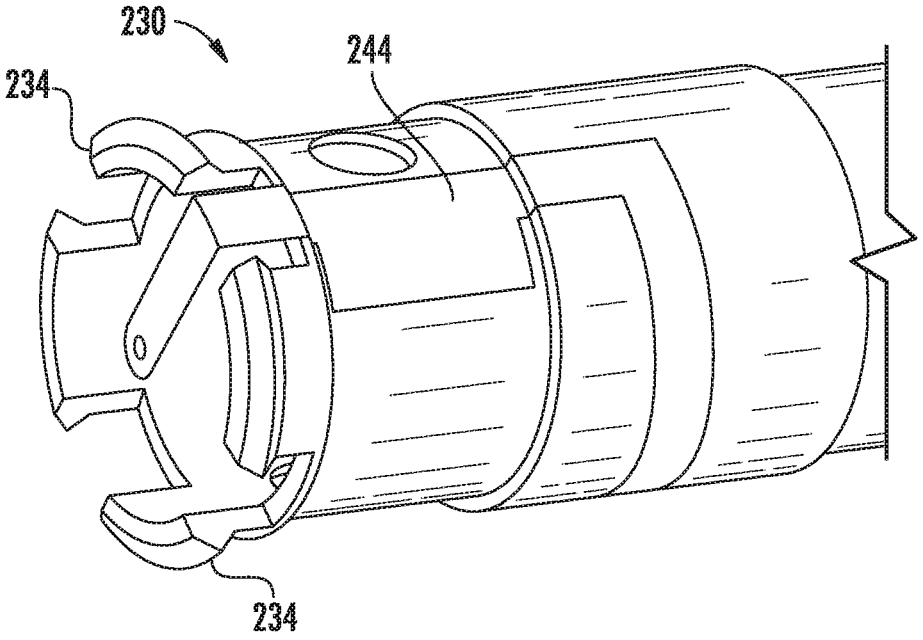
FIG. 8I is an enlarged perspective view of an end portion of the tubular dielectric frame of FIG. 8C with the microstrip transmission line mounted thereon.
Figure 8J:
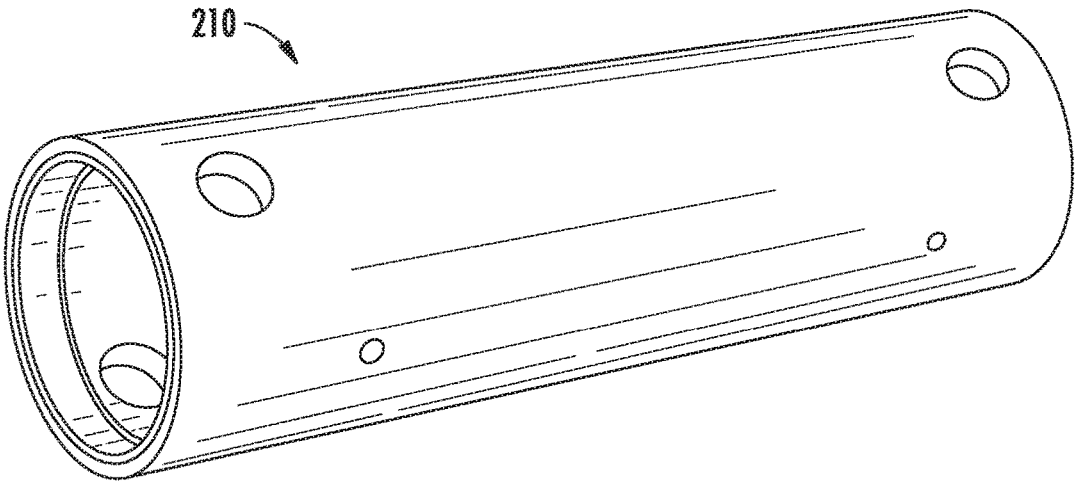
FIG. 8J is a perspective view of the tubular metallic housing of the filter of FIG. 8A.
Figure 8K:
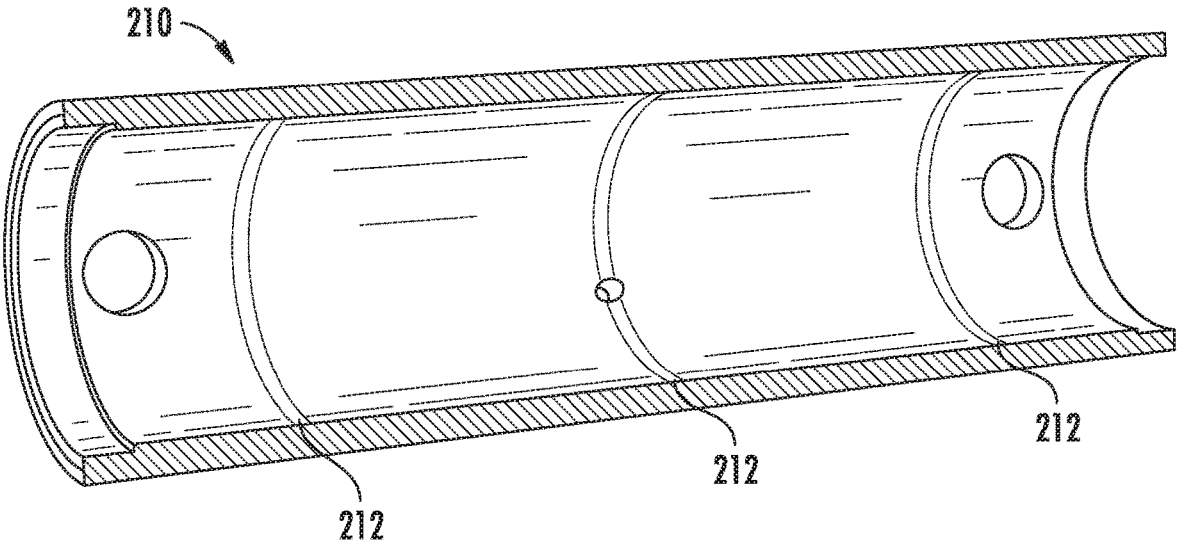
FIG. 8K is a perspective sectional view of the tubular metallic housing of the filter of FIG. 8A.

FIGS. 8A-8K illustrate a filter 200 according to embodiments of the present invention. In particular, FIG. 8A is a perspective view of the filter 200 and FIG. 8B is an exploded perspective view of the filter 200. FIG. 8C is a perspective view of a tubular dielectric frame included in the filter 200 that has a transmission line formed thereon. FIG. 8D is a perspective view of the tubular dielectric frame with three resonators mounted thereon, and FIG. 8E is a perspective view of the tubular dielectric frame with both the microstrip transmission line and the resonators mounted thereon. FIG. 8F is a perspective view of one of the resonators. FIG. 8G is a perspective sectional view of the tubular dielectric frame. FIG. 8H is another perspective view of a tubular dielectric frame of the filter 200, and FIG. 8I is an enlarged perspective view of an end portion of the tubular dielectric frame. Finally, FIGS. 8J and 8K are a perspective view and perspective sectional view, respectively of the tubular metallic housing of the filter 200.

The filter 200 shown in FIGS. 8A-8K is a bandstop filter. As known to those of skill in the art, a bandstop filter is a filter that attenuates a specific, and often relatively narrow, frequency band. Bandstop filters are often used in wireless communications applications in order to suppress an offending signal that may be present that would interfere with the receiver. In other embodiments, the filters may comprise bandpass filters that are designed to only pass signals in a specific frequency band. These bandpass filters may or may not be designed to have transmission zeros (i.e., steep nulls that may be included to provide a sharper frequency response at the band edges). An example embodiment of a bandpass filter is discussed below with reference to FIG. 13. In still other embodiments, more complex filter structures may be implemented such as diplexers, duplexers, smart bias tees, dual mode resonators and the like.

As shown in FIG. 8A, the filter 200 includes the tubular metallic housing 210 and a pair of connectors 220-1, 220-2 that are mounted on either end of the tubular metallic housing 210. The filter 200 comprises an in-line filter that may be connected, for example, between two patch cords, two pieces of equipment, or a patch cord and a piece of equipment. The connectors 220 may comprise, for example, coaxial connectors such as 7/16 connectors. The tubular metallic housing 210 may be formed of any suitable metal such as, for example, aluminium. In some embodiments, an outer diameter of the tubular metallic housing 210 may be the same size or slightly larger than the diameter of the cable of a patch cord that is connected to the filter 200. While the tubular metallic housing 210 is cylindrical in shape (having a circular transverse cross-section) in the depicted embodiment, it will be appreciated that in other embodiments the tubular metallic housing 210 may have square, rectangular, or another arbitrary transverse cross-section. The tubular metallic housing 210 may include a plurality of annular grooves 212 on the inner surface thereof, as is best shown in FIGS. 8B and 8K. While not shown in the figures, a protective housing may optionally be provided over the tubular metallic housing 210.

As shown in FIG. 8B, the filter 200 may further include a tubular dielectric frame 230, a transmission line 240, and a plurality of resonators 250. The tubular dielectric frame 230 and/or the transmission line 240 may be omitted in some embodiments. The tubular dielectric frame 230 may be formed of an insulating material. In an example, embodiment, the tubular dielectric frame 230 may comprise an Ultem 1000 plastic tube having a dielectric constant of about 3 and a dielectric loss factor of about 0.005. The tubular dielectric frame 230 may be sized to fit within the tubular metallic housing 210. While the tubular metallic housing 210 and the tubular dielectric frame 230 of filter 200 are illustrated as having a constant diameter, this need not be the case. In other embodiments, the diameter of these elements and/or the shape of these elements may change along the longitudinal length of the filter.

The transmission line 240 may be formed or otherwise placed on the tubular dielectric frame 230. In the depicted embodiment, the transmission line 240 is on the outer surface of the tubular dielectric frame 230. In other embodiments, the transmission line 240 may be on or adjacent the inner surface of the tubular dielectric frame 230. The transmission line 240 may be a microstrip transmission line 240 in some embodiments. It will be appreciated that any appropriate transmission line may be used as the transmission line 240, specifically including a metal transmission that is formed by depositing metal on the tubular dielectric frame 230.

Referring now to FIG. 8C, the transmission line 240 includes transmission line segments 242 and capacitive coupling sections 244. The capacitive coupling sections 244 may be wider than the transmission line segments 242 in order to facilitate enhanced coupling with the resonators 250, as will be explained in further detail herein. The transmission line segments 242 may include at least one segment (e.g., segment 242-3) that is not collinear with at least one of the other segments (e.g., segment 242-1). Each end of the transmission line 240 may be bent at an angle of, for example, about 90 degrees, as is shown in FIGS. 8B, 8G and 8I. As can best be seen in FIG. 8G, each end of the transmission line 240 may have a cut-out that facilitates mechanically and electrically connecting each end of the microstrip transmission line 240 to a central conductor of the respective connectors 220-1, 220-2 (e.g., by soldering).

Figure 4:
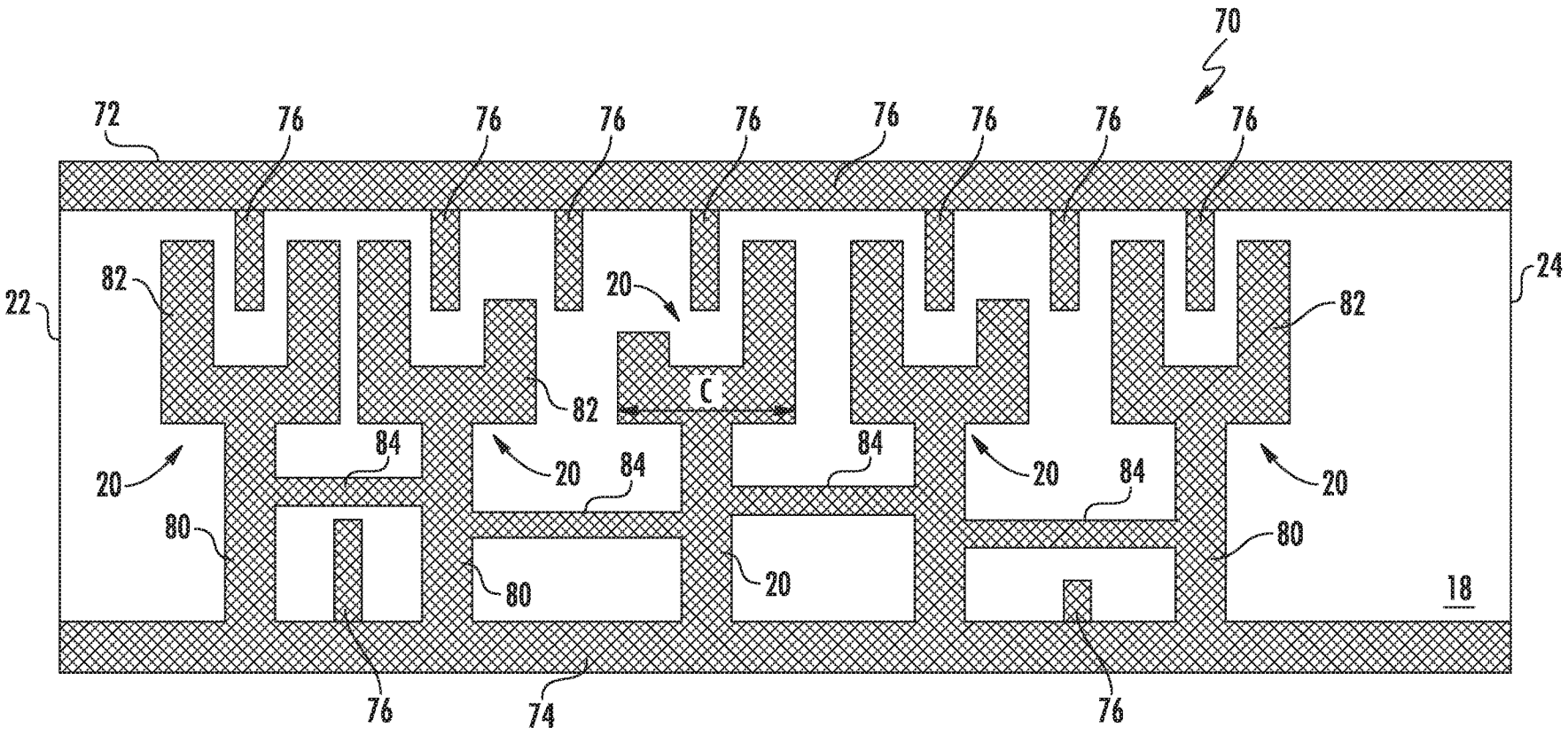
FIG. 4 is a schematic side sectional view of a conventional in-line resonant cavity filter that has a filter response with transmission zeros.

The transmission line 240 may be capacitively coupled to the resonators 250. This is contrast to the conventional filters discussed above (e.g., the filter 70 of FIG. 4) in which a distributed galvanic coupling element is provided.

Referring now to FIGS. 8B, 8D and 8F, the resonators 250 may each comprise a stalk 252 that has first and second capacitive loading elements 254 connected on either end thereof. In the depicted embodiment, the stalk 252 may comprise a cylindrical rod (i.e., a rod with a circular transverse cross-section). In other embodiments, the stalk 252 may have rectangular transverse cross-sections or transverse cross-sections having some other arbitrary shape. The transverse cross-sections of the stalk 252 need not have the same dimensions. The stalks 252 may be longer than they are wide. The first and second capacitive loading elements 254 may comprise respective thin strips of sheet metal that are each referred to herein as an "arm." A center of the first arm 254-1 is attached to a first end of the stalk 252 and a center of the second arm 254-2 is attached to a second end of the stalk 252. In some embodiments, the arms 254 may be bent to generally conform to the outer diameter of the tubular dielectric frame 230 and/or to an inner diameter of the tubular metallic housing 210. The arms 254 may have a wide variety of different shapes. The arms 254 may have a relatively large surface area to facilitate capacitive coupling with other structures (e.g., the transmission line 240). Small insulating spacers 256 may be mounted to extend both inwardly and outwardly from each arm 254. Each spacer 256 may comprise a hemispherical shaped plastic rivet having a stem extending therefrom. The stems of the spacers 256 may be mounted in and extend through respective openings in the arms 254.

The resonators that are included in the filter 200 may be quarter-wavelength or half-wavelength resonators in some embodiments. In the depicted embodiment, three half-wavelength resonators 250 are included. Herein, a half-wavelength resonator refers to a resonator that has a stalk with both ends thereof open. A desired resonant frequency may be achieved with a half-wavelength resonator by providing a metal arm on one or both ends of the stalk that provides capacitive loading. Resonators having a wide variety of different shapes may be used in the filter 200. Thus, it will be appreciated that the resonators 250 are only provided as examples. Other example resonators are discussed below with reference to FIGS. 14A-14B and 15A-15B.

As shown in FIGS. 8D and 8E, the stalk 252 of each resonator 250 may extend through the tubular dielectric frame 230. As shown best in FIGS. 8H and 10A, holes are provided in the tubular dielectric frame 230 that the stalks 252 extend through. These holes may not provide mechanical support to the resonators 250. The arms 254 of each resonator 250 may be on the exterior of the dielectric frame 230. As shown best in FIG. 8I, the tubular dielectric frame 230 may have cantilevered spring fingers 234 on the ends thereof that are used to mount the tubular dielectric frame 230 in a desired position within the tubular metallic housing 210. The resonators 250 are maintained in their proper position by the spring force of the arms 254 having the dielectric spacers 256 thereon. In the depicted embodiment, the resonator arms 254 may be curved arms having a radius slightly larger than the inner diameter of the tubular metallic housing 210 so that the arms 254 are spring-biased outwardly toward the tubular metallic housing 210. The dielectric spacers 256 may maintain separation between the arms 254 and the tubular metallic housing 210. The resonator arms 254 may couple very strongly with the tubular metallic housing 210, and thus the primary coupling between adjacent and non-adjacent resonators 250 may be inductive coupling between the resonator stalks 252. In other embodiments, the arms 254 could be spring biased toward the tubular dielectric frame 230. The arms 254 of the resonators 250 extend over the capacitive coupling sections 244 of the microstrip transmission line 240. As noted above, the stems of the dielectric spacer 256 may separate each capacitive coupling section 244 from the arm 254 that extends thereover.

As shown in FIG. 8B, the tubular dielectric frame 230 with the transmission line 240 and resonators 250 mounted thereon is mounted within the interior of the tubular metallic housing 210. The spacers 256 may ensure that the resonators 250 are not in direct contact with the tubular metallic housing 210 and/or the transmission line 240. The tubular metallic housing 210 may be connected to a ground conductor of each of the connectors 220-1, 220-2 and may serve as a ground plane for the filter 200. As the resonators 250 do not contact the tubular metallic housing 210 they may be floating. As shown best in FIG. 8K, annular grooves 212 may be formed in the interior surface of the outer metallic tube 210. The hemispherical spacers 256 may be received within these grooves 212 to facilitate ensuring that the resonators 250 do not contact the tubular metallic housing 210. In other embodiments, the spacers 256 may be omitted and other elements or mechanisms may be used to keep the resonators 250 out of direct electrical contact with the tubular metallic housing 210 and the transmission line 240. For example, a dielectric coating may be sprayed on the inside of the tubular metallic housing 210 in other embodiments.

Referring to FIG. 8D, the stalks 252 of adjacent ones of the resonators 250 may be rotated with respect to each other so that they have different angular orientations within the tubular metallic housing 210. In an example embodiment, the stalk 252 of the middle resonator 250-2 may be rotated about 90 degrees with respect to the stalks 252 of the resonators 250-1, 250-3 that are on either end of the filter 200. This rotation to an orthogonal orientation may reduce or minimize mutual coupling between adjacent resonators 250 without the need for cavities that separate adjacent resonators 250.

As discussed above, in the filter 200 there will be both inductive and capacitive coupling between each pair of adjacent resonators 250. For adjacent resonators 250, the sign (polarity) of the capacitive coupling will be opposite the sign (polarity) of the inductive coupling. As such, the inductive and capacitive coupling can compensate each other to some degree. Additionally, since no intervening walls are provided between the resonators 250, more substantial cross-coupling may occur between non-adjacent resonators 250. Thus, there may be non-negligible cross-coupling (e.g., inductive coupling) between the non-adjacent resonators 250-1 and 250-3. The amount of capacitive coupling and the amount of inductive coupling together define the amount of coupling between a pair of resonators (whether adjacent or non-adjacent).

The mutual coupling between adjacent or non-adjacent resonators 250 may be increased or reduced by the relative orientation of the stalks 252 of the resonators 250. This allows a filter designer to readily adjust the amount of coupling between both adjacent and non-adjacent resonators 250 in order to achieve a desired frequency response. Thus, the filter 200 may be designed to have frequency responses similar to that of conventional multi-cavity resonant cavity filters using a tubular metallic housing that only has a single cavity. The use of a single cavity may reduce the size, complexity and cost of the filter.

In order to achieve a desired frequency response in a filter having, for example, three resonators, it may be necessary to control the coupling between (1) the first resonator and the second resonator, (2) the second resonator and the third resonator and (3) the first resonator and the third resonator.

In conventional in-line filters, the coupling between the first and third resonators is very weak and there is often little that can be done to effect this coupling. The filters according to embodiments of the present invention provide an extra degree of freedom as much stronger, and controllable, coupling may be achieved between the first and third resonators The filter 200 may be a bandstop filter that has a pass-band from 906.8 MHz to 960 MHz and a stop-band between 880-890 MHz. Rejection in the stop-band may be a minimum of 40 dB with a typical minimum rejection of 42 dB. Such a filter may be used to remove an interfering signal that might otherwise be present. The filter 200 may have a length (excluding the connectors 220) of about 125 mm and a diameter of about 35 mm. It is anticipated that the filter 200 may weigh less than 0.5 kg.

Figure 9A:
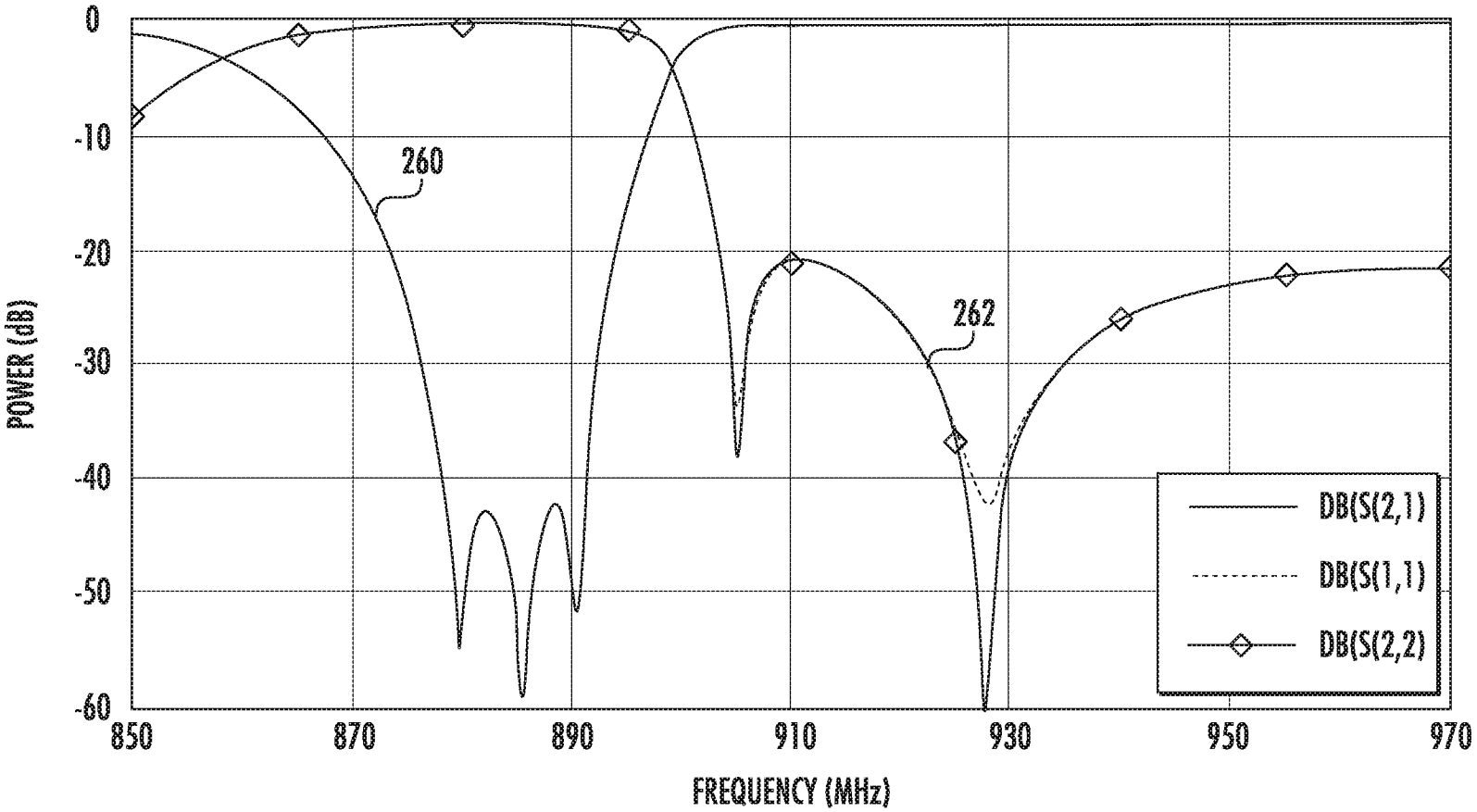
FIG. 9A is a graph that shows the simulated frequency response and return loss for a simple model of a filter having the design of the filter of FIGS. 8A-8K.

FIG. 9A is a graph illustrating the simulated frequency response (curve 260) and return loss (curve 262) for a simple model of the filter 200. As shown in FIG. 9A, the frequency response for filter 200 exhibits a deep null in the vicinity of 880-890 MHz, having a minimum attenuation of at least 42 dB in this frequency range. The response of filter 200 recovers quickly, and the attenuation is less than 0.5 dB at frequencies above 905 MHz. Thus, the filter 200 may be used to remove an interfering signal that is very close to the pass band (15 MHz away). The measured Qu factor for the resonators 250 is between about 1500 and 1800, with a value of 1600 being typical. The higher the Qu value fix a resonator the lower the expected insertion loss. The Qu factors for the resonators 250 approach the Qu values expected with a standard air-filled coaxial resonator.

The return loss refers to the power incident on a port of filter 200 that is reflected back due to a discontinuity or impedance mismatch. As shown by curve 262 in FIG. 9A, almost all of the power in the 880-890 MHz range is reflected back, while the return loss is less than −20 dB throughout the pass-band of the filter 200.

Figure 9B:
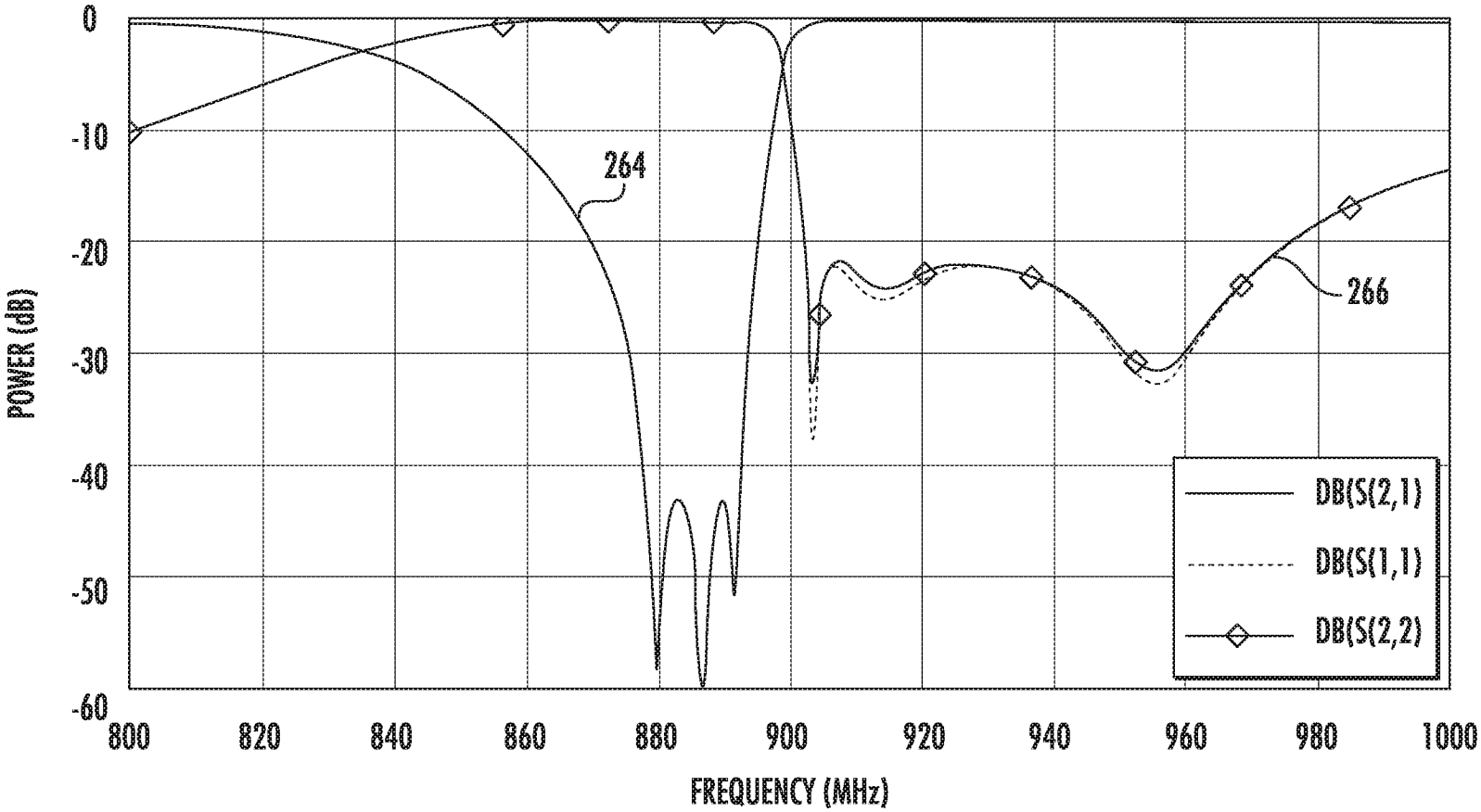
FIG. 9B is a graph that shows the simulated frequency response and return loss for a three-dimensional model of a filter having the design of the filter of FIGS. 8A-8K.

FIG. 9B is a graph illustrating the simulated frequency response (curve 264) and return loss (curve 266) of a three-dimensional electromagnetic model of the filter 200. As shown in FIG. 9B, the frequency response and return loss are similar to the frequency response and return loss shown in FIG. 9A. Rejection in the stop band exceeds for filter 200 exhibits a deep null in the vicinity of 880-890 MHz, having a minimum attenuation of at least 43 dB in this frequency range. Curve 264 shows that in the pass-band the attenuation is less than 0.4 dB.

Figure 10A:
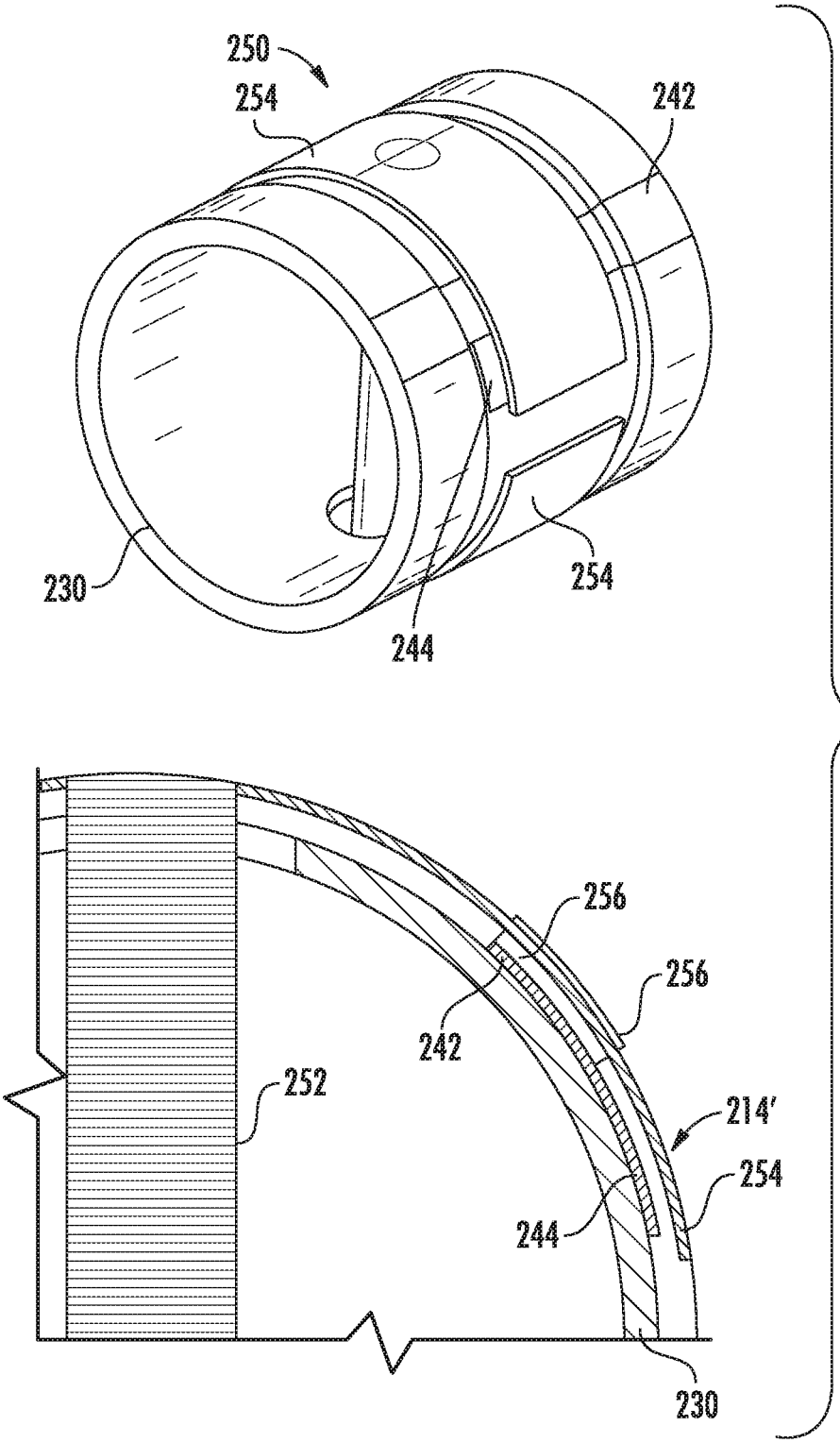
FIG. 10A is a perspective view and an enlarged cross-sectional view of a longitudinal segment of the filter of FIGS. 8A-8K.
Figure 10B:
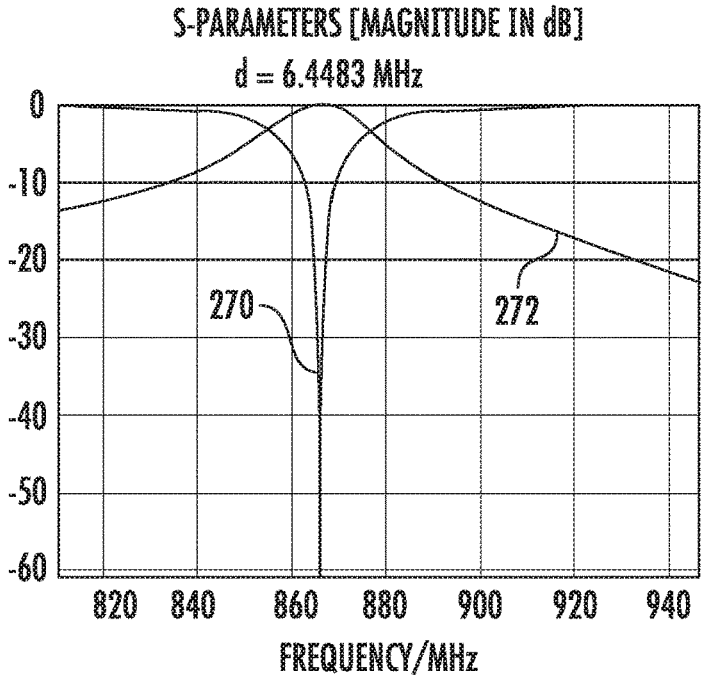
FIG. 10B is a graph illustrating the response of a single resonator of the filter of FIGS. 8A-8K.
Figure 10C:
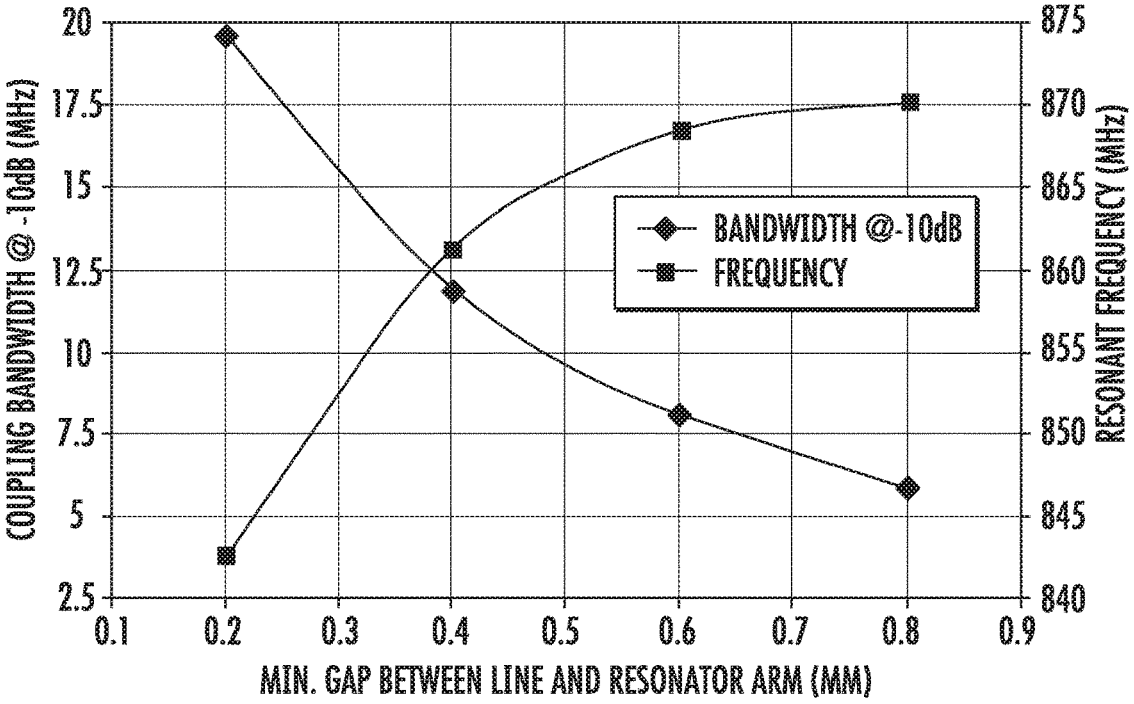
FIG. 10C is a graph illustrating the effect of the gap between the resonator arm and the transmission line on the coupling bandwidth and resonant frequency.
Figure 11:
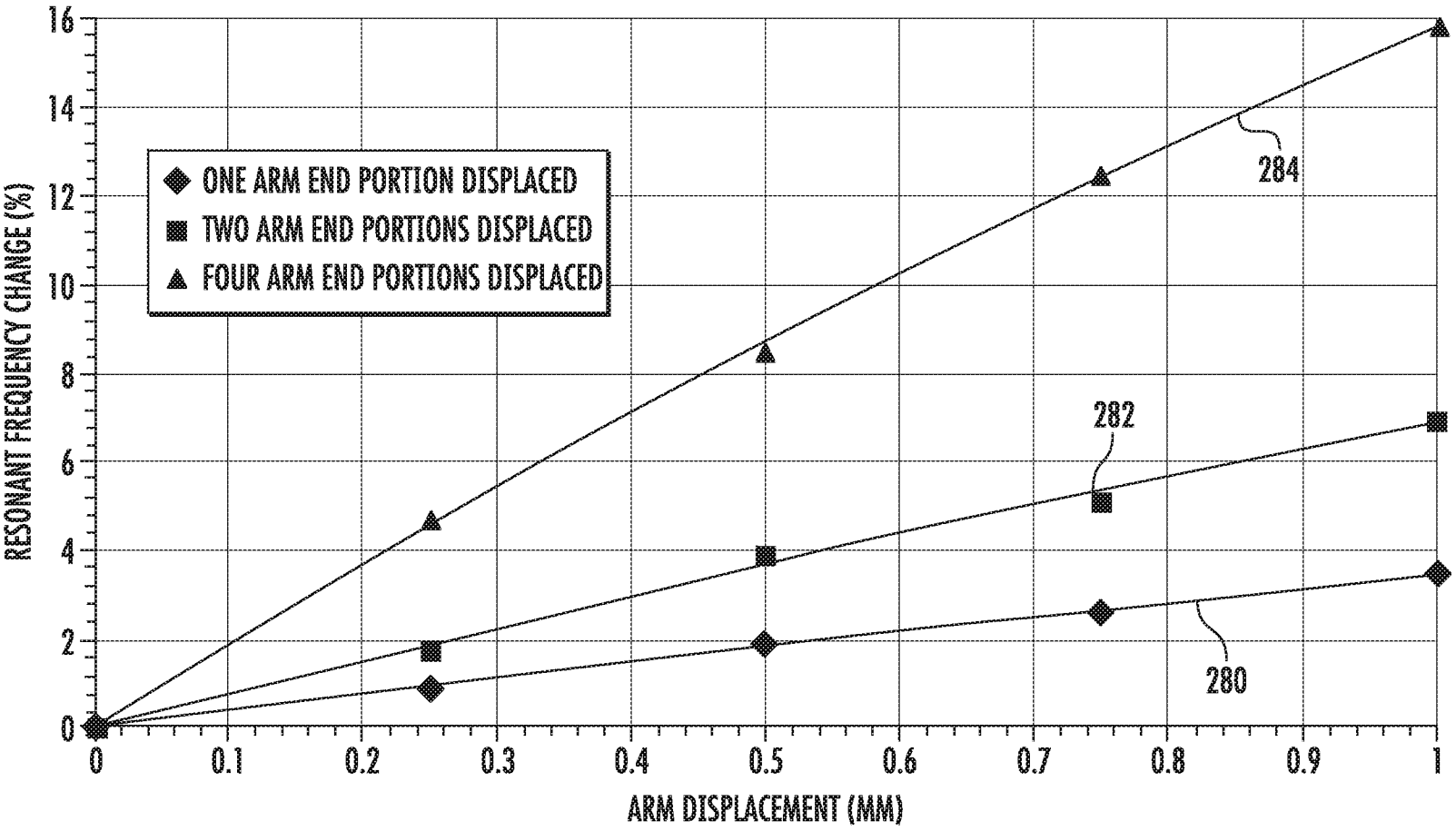
FIG. 11 is a graph that shows the simulated tenability the resonant frequency of tubular filters having the resonator design of the filter of FIGS. 8A-8K.

FIGS. 10A-10C and 11 illustrate the tunability of the filter 200 to operate at different resonant frequencies as well as the effect that tuning the filter 200 has on the coupling bandwidth of the filter 200. In particular, FIG. 10A is a perspective view and an enlarged cross-sectional view of a longitudinal segment of the filter 200 (with the metallic housing 210 removed) that show how the arms 254 of the resonators 250 may be bent inwardly to tune the filter 200. FIG. 10B is a graph illustrating the response of a single resonator 250 of the filter 200. FIG. 10C is a graph illustrating the effect of the gap between the arm 254 of the resonator 250 and the transmission line 240 on the coupling bandwidth and resonant frequency. Finally, FIG. 11 is a graph that shows the simulated tunability of the resonant frequency for a filter that is similar to the filter 200 as a function of the amount of movement of the resonator arms 254.

Referring first to FIG. 10A, it can be seen in the cross-sectional view that the arm 254 of the resonator 250 extends over both the transmission line segment 242 and the capacitive coupling section 244 of the transmission line 240. An optional spacer 256 may be provided that spaces the arm 254 apart from the underlying transmission line segment 242. The top portion of the spacer 256 may be used to space the arm 254 apart from the inner surface of the tubular metallic housing 210, as discussed above The spacers 256 may also space the resonator arms 254 apart from the transmission line 240. In some embodiments, the arm 254 may directly contact the transmission line 240. Typically, the amount of coupling between the transmission line 240 and the resonator 254 should be within a certain range that is sufficient to provide proper filter operation without exceeding the power handling requirements of the filter. The transmission line 240 may include the capacitive coupling section 244 in some embodiments in order to achieve a desired minimum level of coupling while also keeping a reasonable amount of separation between the transmission line 240 and the resonators 250. In an example embodiment, the arm 254 may be nominally spaced apart from the tubular dielectric frame 230 by 1 mm and may be nominally spaced apart from the transmission line segment 242 and capacitive coupling section 244 by 0.8 mm. The lower portion of the spacer 256 may space the arm 254 apart from the tubular dielectric frame 230 and the transmission line 240 by these nominal distances.

Referring to FIG. 8B, plastic tuning screws 214 may be provided that extend through threaded apertures in the tubular metallic housing 210. Three example tuning screws 214 are depicted in FIG. 8B, but it will be appreciated from the following discussion that four tuning screws 214 may be provided for each resonator 250. Each arm 254 has first and second end portions, and tuning screw 214 may be positioned above a respective end portion of an arm 254. The arrow labelled 214' in FIG. 10A illustrates an example location for a tuning screw 214 that is configured to operate on a first end portion of a first arm 254 of a resonator 250. The tuning screw 214 may be used to push the end portion of the resonator arm 254 inwardly closer to the underlying capacitive coupling segment 244 of the transmission line 240 to increase the amount of capacitive coupling between the resonator arm 254 and the transmission line 240.

FIGS. 10B, 10C and 11 illustrate the impact of moving the resonator arm 254 closer to the transmission line 240 on both the resonant frequency and the coupling bandwidth of the filter 200. In particular, FIG. 108 shows the frequency response (curve 270) and return loss (curve 272) of one of the resonators 250 coupled to the transmission line 240. The coupling bandwidth may be defined as the bandwidth of the frequency response at −10 dB. FIG. 108 is for the case where the resonator arms 254 are all in their nominal positions. As shown, in this position, the coupling bandwidth is about 6.5 MHz. FIG. 10C is a graph showing the −10 dB coupling bandwidth and the resonant frequency of the filter 200 as a function of the minimum distance between the resonator arms 254 and the underlying transmission lines 240. A minimum distance (gap) of 0.2 mm was assumed to ensure that the arms 254 do not physically contact the transmission line 240. As shown in FIG. 10C, the coupling bandwidth varies from about 6-20 MHz depending upon the size of the gap. The resonant frequency varies from between about 842 MHz to about 870 MHz over this tuning range.

FIG. 11 illustrates the simulated change in the resonant frequency as a function of the amount that the end portions of the resonator arms 254 of one of the resonators 250 are displaced. In this simulation, the filter was modelled as having a tubular metallic housing having a diameter of 29 mm and a length of 30 mm with a transmission line 240 and a single resonator 250 mounted thereon. The nominal spacing of the resonator 250 from the transmission line 240 was 1 mm, which resulted in a resonant frequency of 951 MHz. Each resonator 254 has two arms, and each arm has two end, portions. Thus, a total of four arm end portions may be displaced inwardly. The more that each arm 254 is displaced, and the greater the number of arm end portions that are displaced, the greater the range to which the resonant frequency of the filter 200 may be tuned.

As shown by curve 280 in FIG. 11, by displacing one end portion of the resonator arm 254 inwardly the resonant frequency of the filter 200 can be increased. If the arm is displaced 1.0 mm (note that in filter 200 the resonator arms 254 are separated from the tubular dielectric frame 230 by 1.0 mm), the resonant frequency changes by nearly 4% (which for a resonant frequency of 951 MHz, is a change of almost 40 MHz). The amount of change may be increased by displacing more than one end portion of the arms 254 inwardly. When both end portions of one of the resonator arms 254 are displaced inwardly, the maximum change in the resonant frequency increases to about 7%. The resonant frequency may be adjusted even further by displacing the end portions on both arms 254 of resonator 250 inwardly. When all four end portions are displaced, the resonant frequency may be tuned by about 16%, or over 150 MHz. FIG. 11 also illustrates the amount of tuning that may be achieved when the end portions of the resonator arms 254 are displaced less than the full 1.0 mm. In the embodiment of FIGS. 8A-8K, the transmission line 240 extends under one of the end portions of one of the arms 254 of each resonator 250. Thus, one end portion of one arm 254 may be used to tune the coupling between each resonator 250 and the transmission line 240 and the remaining three arms 254 may be used to tune the resonant frequency.

As noted above, in some embodiments half-wavelength resonators 250 may be used in the filter 200. It will be appreciated that other types of resonators may be used in other embodiments. For example, quarter-wavelength resonators may be used in other embodiments. When quartet-wavelength resonators are used, one end of the resonator may be electrically connected to the outer metallic housing.

When half-wavelength resonators 250 are used, both ends of the resonator 250 may be electrically floating. The resonators 250 may be formed of metal or may include metal. The resonators 250 may be made very compact by designing the resonators 250 to have strong capacitive loading at one or both ends. This may be accomplished, for example, by designing the arms 254 to have a large surface area.

The resonators 250 may held in place in the tubular metallic housing 210 using, for example, small plastic screws. In some embodiments, the arms 254 may be formed of a resilient metal and the spring effect of the resilient metal arms 254 may be used to hold the resonators 250 in their desired positions.

Figure 12:
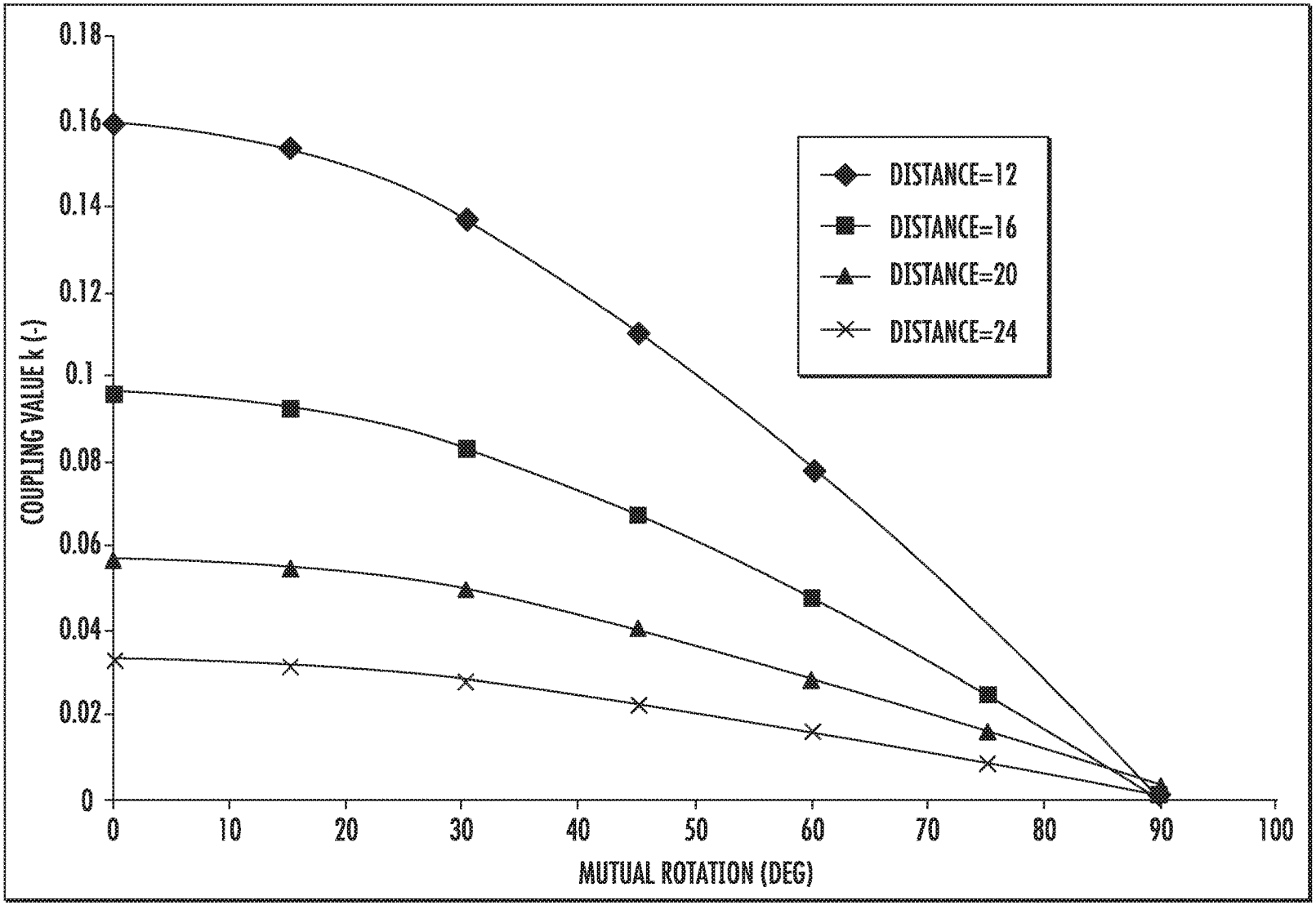
FIG. 12 is a graph that shows the simulated amount of coupling between adjacent resonators of the filter of FIGS. 8A-8K as a function of the relative rotation of the central elements thereof.

The angular orientation of each resonator 250 may be defined by the orientation of the stalk 252 thereof. The mutual angle defined between the stalks 252 of two resonators 250 may be defined as the angle between their orientations. A wide range of coupling values may be achieved by varying the distance and the mutual angle between two resonators. This is shown graphically in FIG. 12, which is a graph of the simulated amount of coupling between adjacent resonators 250 as a function of the relative rotation of the stalks 252 thereof and the spacing (in millimetres) between resonators 250. Notably, as shown in FIG. 12, at a mutual angle of 90 degrees, the coupling between adjacent resonators 250 is zero. As shown in FIG. 12, by varying the distance between resonators and the angular orientations of the resonators 250 a wide variety of different coupling values may be achieved. As such, a filter designer can readily design filters having a wide variety of desired frequency responses.

While the transmission line 240 is shown as being formed on the outside of the tubular dielectric frame 230 in the figures, it will be appreciated that in other embodiments, the transmission line 240 may be formed on the inner surface of the tubular dielectric frame 230. In such embodiments, the tubular dielectric frame 230 may comprise the dielectric between the arms 254 of the resonators and the capacitive coupling sections 244 of the transmission line 240.

Figure 13:
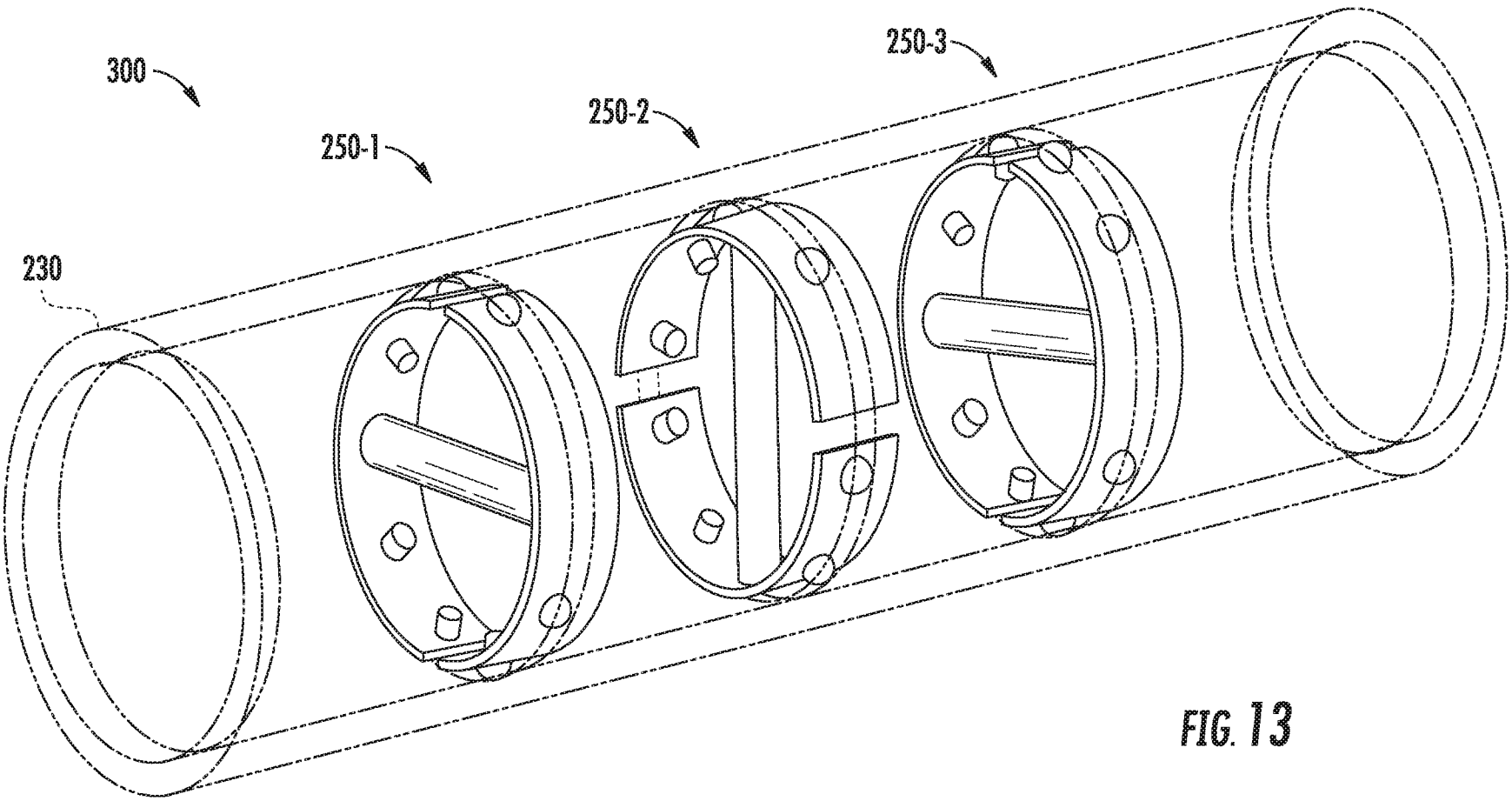
FIG. 13 is a schematic, shadow perspective view of a bandpass filter according to embodiments of the present invention.

While the in-line filter 200 is a bandstop filter, pursuant to further embodiments of the present invention in-line bandpass filters may be provided. The bandpass filters may or may not be designed to include transmission zeros. FIG. 13 is a schematic, shadow perspective view of a bandpass filter 300 according to embodiments of the present invention. As can be seen, the bandpass filter 300, may be similar to the bandstop filter 200, but the transmission line 240 that is included in filter 200 may be omitted in filter 300. In the bandpass filter 300, the distances between adjacent resonators 250 and the orientation angles of the resonators 250 may be selected to have constant, non-resonant couplings between resonators 250. While not shown in FIG. 13, the center conductor of an input connector may be galvanically connected to the stalk 252 of the first resonator 250-1 and the center conductor of an output connector may be galvanically connected to the stalk 252 of the first resonator 250-3. The filter 300 can achieve these non-resonant couplings without the need for any additional distributed coupling elements, which may allow the filter 300 to be smaller and simpler to manufacture than conventional bandpass filters. The bandpass filter 300 may have a narrow to moderate bandwidth. While FIG. 13 illustrates a bandpass filter 300 that is implemented using half-wavelength resonators 250, it will be appreciated that in other embodiments quarter-wavelength resonators may be used instead. It will also be appreciated that the separation between the resonators 250 and the orientation angles of the respective resonators 250 may be selected to include transmission zeros in the filter response in some embodiments.

Figure 14A:
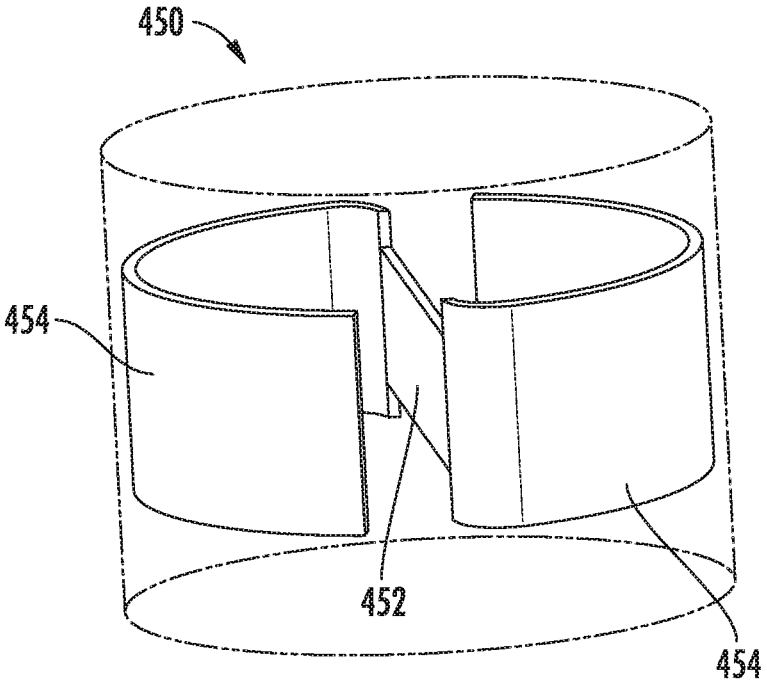
FIG. 14A is a perspective view of a resonator according to further embodiments of the present invention.
Figure 14B:
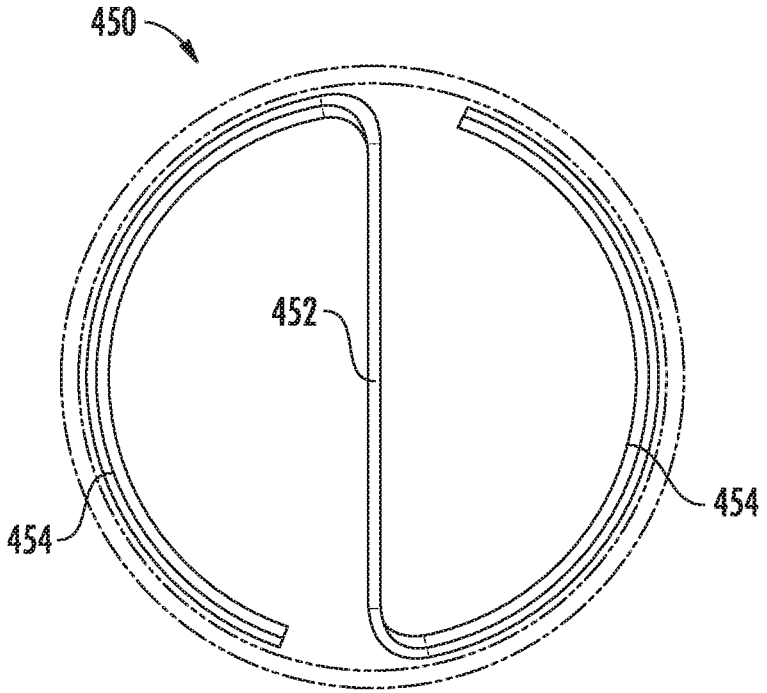
FIG. 14B is a top view of the resonator of FIG. 14A.

FIGS. 14A-14B are a perspective view and a top view, respectively, of a resonator 450 according to further embodiments of the present invention. The resonator 450 could be used, for example, in place of the resonators 250 in the filter 200 or the filter 300.

As shown in FIGS. 14A-14B, the resonator 450 has a stalk 452 and a pair of arms 454. In some embodiments, the resonator 450 may comprise a unitary, monolithic member that may be punched or cut from a piece of sheet metal and formed into the shape shown in FIGS. 14A-14B. In some embodiments, the resonator 450 may be formed of a resilient metal such as, for example, beryllium-copper or phosphor-bronze.

The stalk 452 may comprise a straight, relatively thin member. The stalk 452 may have a rectangular shape in some embodiments and may have first and second opposed end portions. Each arm 454 may extend from a respective end portion of the stalk 452. Each arm 454 may have an arc shape. In some embodiments, the arc defined by each arm 454 may have a substantially constant radius. The resonator 450 may be a half-wavelength resonator, and may be electrically floating when used in filters according to embodiments of the present invention. As noted above, three of the resonators 450 could be used in place of the three resonators 250 to form in-line filters.

Figure 15A:
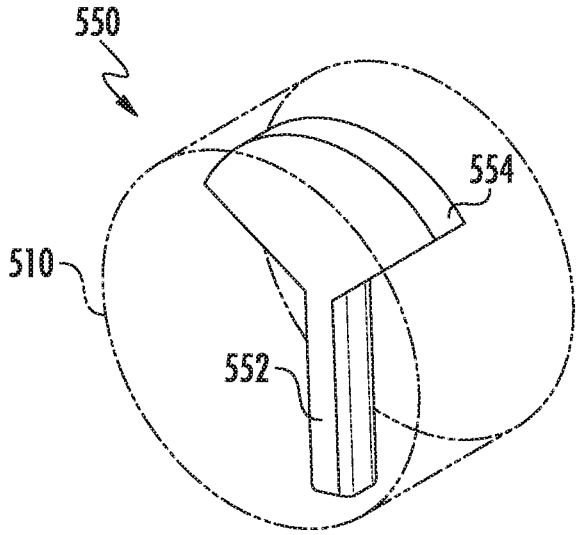
FIG. 15A is perspective view of a resonator according to still further embodiments of the present invention mounted in a tubular filter body.
Figure 15B:
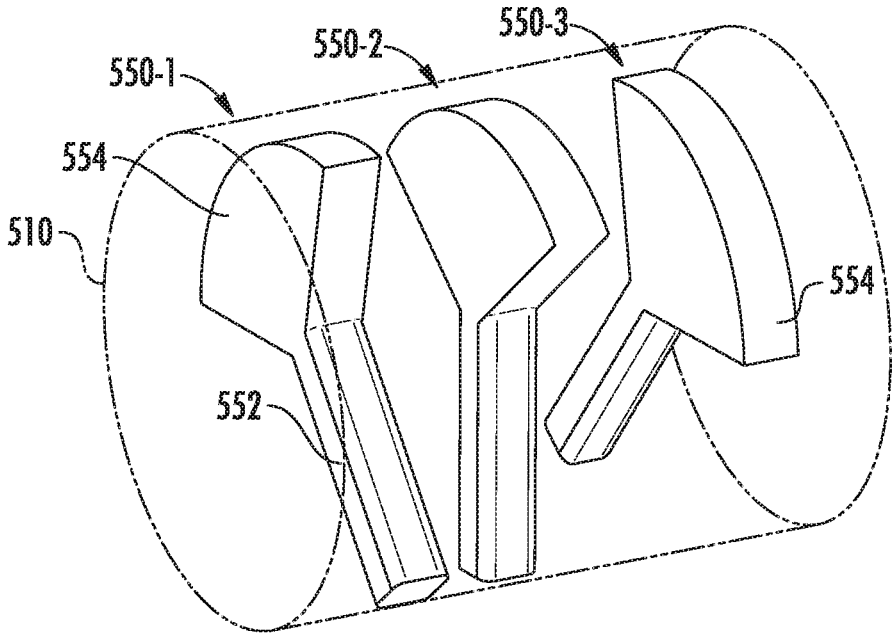
FIG. 15B is perspective view of a pair of the resonators of FIG. 15A mounted in a tubular filter body.

As discussed above, filters according to embodiments of the present invention may also be implemented using quarter-wavelength resonators. FIG. 15A is schematic perspective view of a quarter-wavelength resonator 550 according to further embodiments of the present invention mounted in a tubular metallic housing 510. FIG. 15B is schematic perspective view of three of the resonators 550 mounted in the tubular filter metallic housing 510.

As shown in FIGS. 15A-15B, each resonator 550 may include a stalk 552 and a capacitive loading element 554. The size of the capacitive loading element 554 may be proportional to a desired resonant frequency for the filter that the resonators 550 are used in. At higher frequencies, smaller heads 554 may be used or the head 554 may be omitted altogether. Unlike the resonators 350 and 450 discussed above, which are floating, the stalk 552 of the resonators 550 may be physically and electrically connected to the tubular metallic housing 510. The capacitive loading element 554 may be spaced apart from the tubular metallic housing 510. The capacitive loading element 554 may be capacitively coupled to a transmission line of the filter in some embodiments. The quarter-wavelength resonators 550 may be more compact than the half-wavelength resonators discussed above, and hence may facilitate reducing the overall size of the filter.

Figure 16:
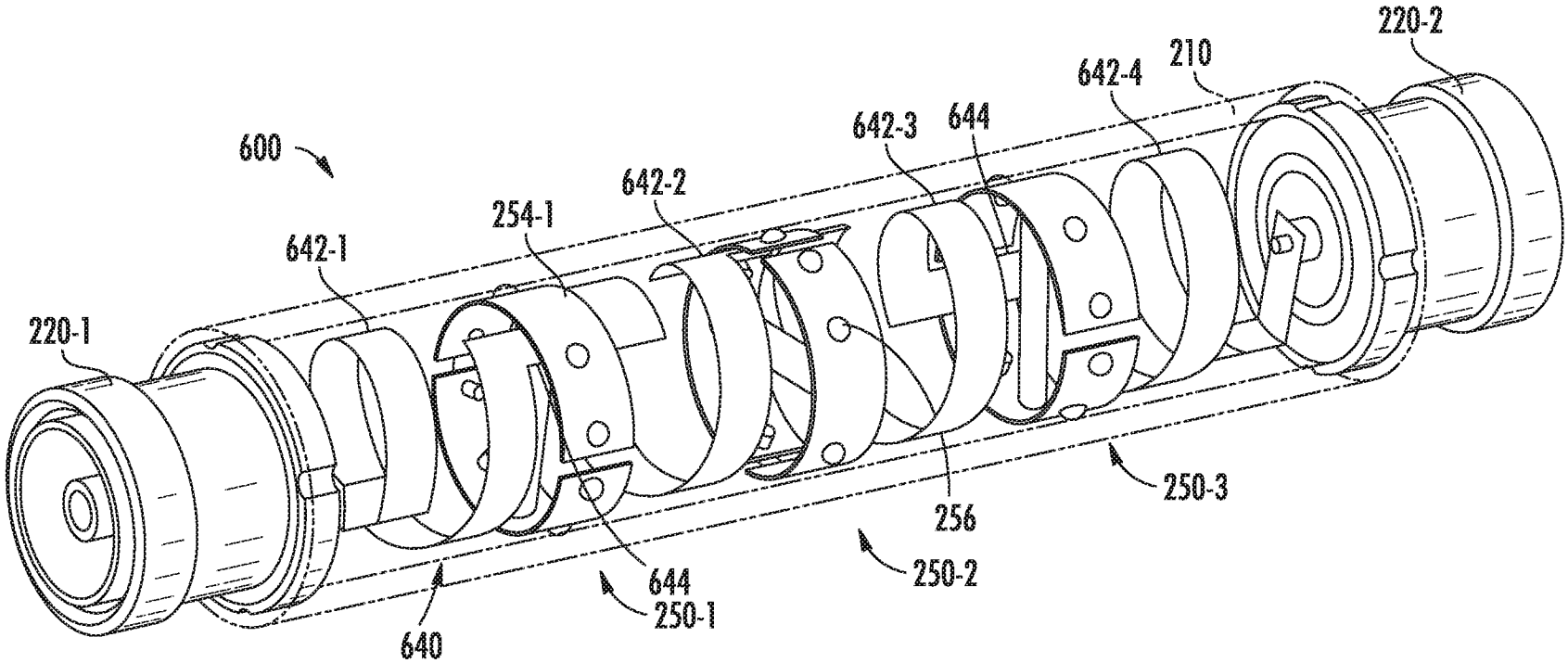
FIG. 16 is a perspective view of a bandstop filter according to further embodiments of the present invention.

FIG. 16 is a perspective view of a filter 600 according to further embodiments of the present invention. The filter 600 is a bandstop filter and is somewhat similar to the bandstop filter 200 that is described above. Accordingly, the description that follows will focus primarily on the differences between the filters 600 and 200.

As shown in FIG. 16, the filter 600 includes a tubular metallic frame 210 and a plurality of resonators 250. The filter 600 includes a helical transmission line 640 that is disposed inside the tubular metallic housing 210. In the filter 600, the tubular dielectric frame 230 that is included in filter 200 may be omitted. The helical transmission line 640 may define a cylinder that has a diameter that is approximately the same as the diameter of the circle defined by the arms 254 of the resonators 250. The helical transmission line 640 includes connecting segments 642 and capacitive coupling segments 644 that pass underneath arms 254 of the respective resonators 250. While not shown in FIG. 16, the helical transmission line 640 may include spacers that are similar or identical to the spacers 256 included in the resonators 250 in order to ensure that the transmission line 640 does not contact the tubular metallic housing 210.

Figure 17A:
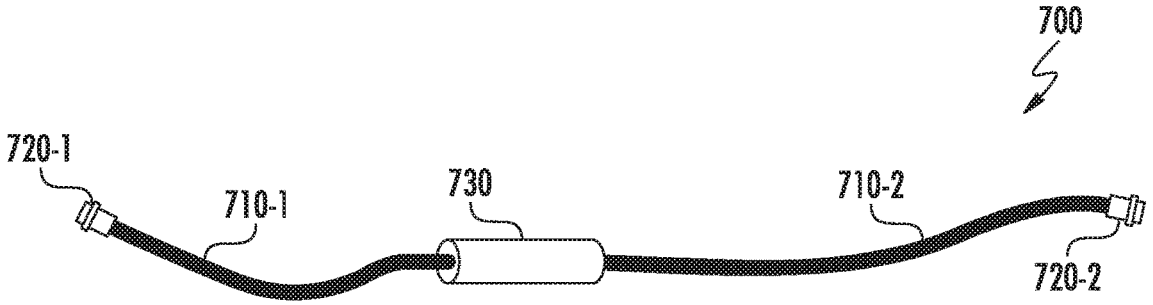
FIG. 17A is a schematic diagram of a patch cord according to embodiments of the present invention.
Figure 17B:
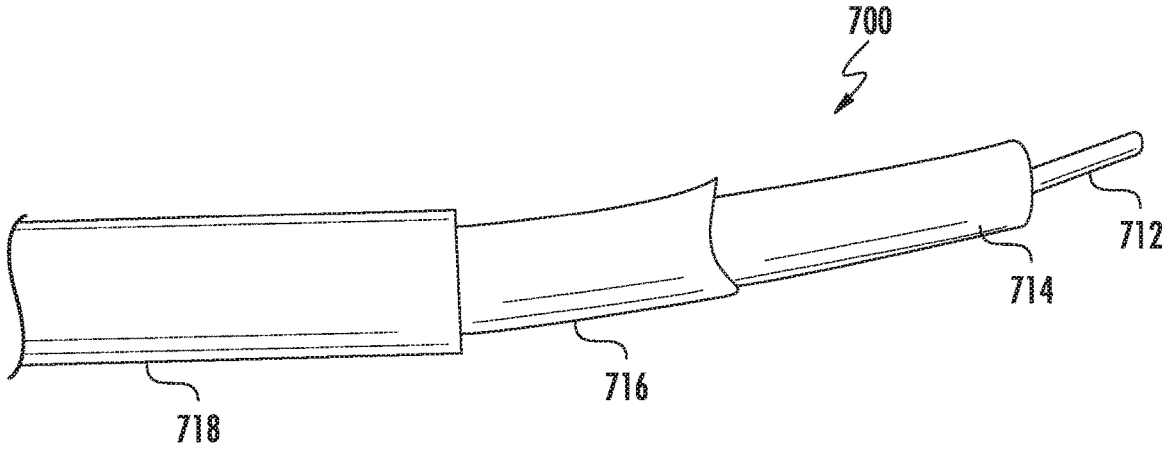
FIG. 17B is a schematic, partially cut away perspective view of a coaxial cable segment of the patch cord of FIG. 17A.

As discussed above with reference to FIG. 7, in some embodiments of the present invention, the filters discussed herein may be integrated into a patch cord such as a coaxial patch cord. FIGS. 17A-17B illustrate various aspects of a patch cord 700 that includes an in-line filter according to embodiments of the present invention integrated therein. As shown in FIG. 17A, the patch cord 700 includes first and second coaxial cable segments 710-1 710-2. FIG. 17B is a schematic perspective view, partially cut-away view of one of the coaxial cable segments 710 that illustrates the components thereof in greater detail. As shown in FIG. 17B, each coaxial cable segment 710 may have an inner conductor 712 that is surrounded by a dielectric spacer 714. A tape (not shown) may be bonded to the outside surface of the dielectric spacer 714. An outer conductor in the form of, for example, a metallic electrical shield 716 surrounds the inner conductor 712, dielectric spacer 714 and any tape. The electrical shield 716 serves as an outer conductor of the coaxial cable 710. Finally, a cable jacket 718 surrounds the electrical shield 716 to complete the coaxial cable 710.

Referring again to FIG. 17A, a first coaxial connector 720-1 may be provided on one end coaxial cable segment 710-1 and an filter 730 according to embodiments of the present invention may be connected to the other end of coaxial cable segment 710-1. Likewise, a second coaxial connector 720-2 may be provided on one end coaxial cable segment 710-2 and the inline filter 730 may be connected to the other end of coaxial cable segment 710-2. The filter 730 may comprise, for example, a bandstop filter, a bandpass filter or the like. If the filter includes a transmission line (e.g., transmission line 240 of filter 200), one end of the transmission line may be connected to the inner conductor 712 of coaxial cable segment 710-1 and the other end of the transmission line may be connected to the inner conductor 712 of coaxial cable segment 710-2. The electrical shield 716 of each coaxial cable segment 710 may be electrically connected to the tubular metallic housing (e.g., tubular metallic housing 210 of filter 200) of the filter 730.

Figure 17C:
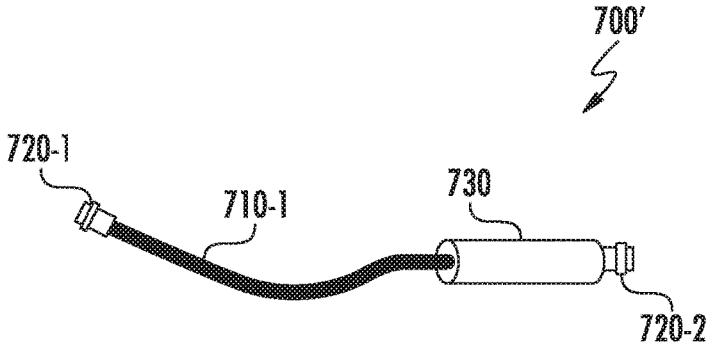
FIG. 17C is a schematic diagram of a patch cord according to further embodiments of the present invention.

As shown in FIG. 17C, in some embodiments the cable segment 710-2 may be omitted and the filter 730 may be coupled directly to coaxial connector 720-2 to provide a patch cord 700'.

The filters according to embodiments of the present invention are suitable for use in cellular communications systems. In some embodiments, the filters may be used to implement various of the filters that are included in a cellular base station.

Figure 18:
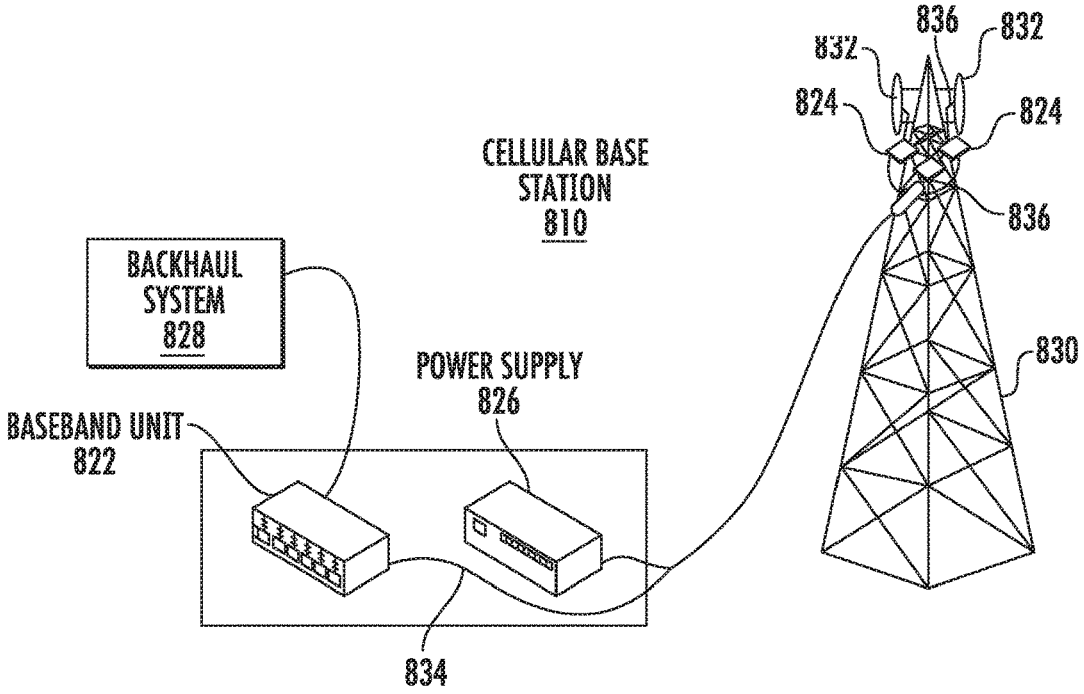
FIG. 18 is a highly simplified, schematic diagram of a conventional cellular base station.

FIG. 18 is a highly simplified, schematic diagram that illustrates a conventional cellular base station 810. As shown in FIG. 18, the cellular base station 810 includes an antenna tower 830 that has several antennas 832 mounted thereon. A plurality of baseband units 822 (only one is shown in FIG. 18) are located at the bottom of the tower 830 and may be in communication with a backhaul communications system 828 A plurality of remote radio heads 824 are mounted on the antenna tower 830 proximate the respective antennas 832. Typically, two or three remote radio heads 824 may be provided per antenna 832, although only three remote radio heads 824 are shown in FIG. 18 to simplify the drawing. Fiber optic cables 834 connect each baseband unit 822 to a respective one of the remote radio beads 824. Coaxial patch cords 836 are used to connect the remote radio heads 824 to the antennas 832.

The antennas 832 are often configured to support multiple types of cellular service. For example, a common configuration is for an antenna 832 to have a first linear array of radiating elements that supports a cellular service that transmits in a first (e.g., low) frequency band and a second linear array of radiating elements that supports a cellular service that transmits in a second (e.g., high) frequency band. Moreover, in some cases, one or both of the first or second linear arrays of radiating elements may be used to support two different types of service.

Figure 19A:
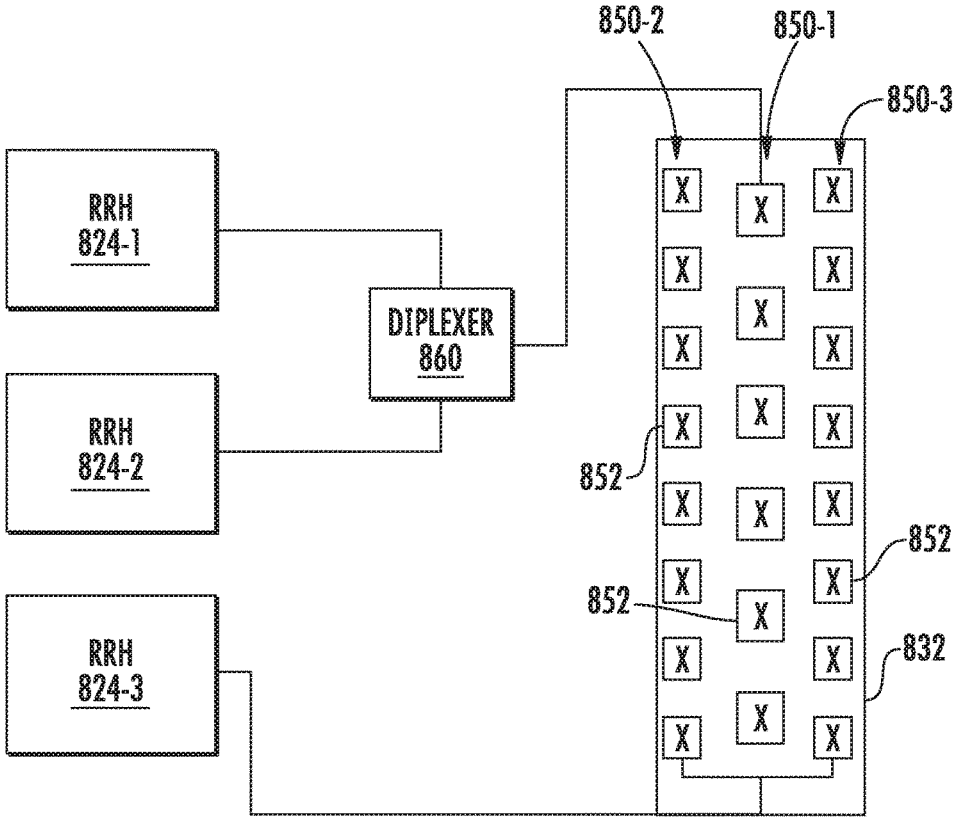
FIGS. 19A-C are schematic block diagrams illustrating how filters according to embodiments of the present invention could be used in cellular base stations.
Figure 19B:
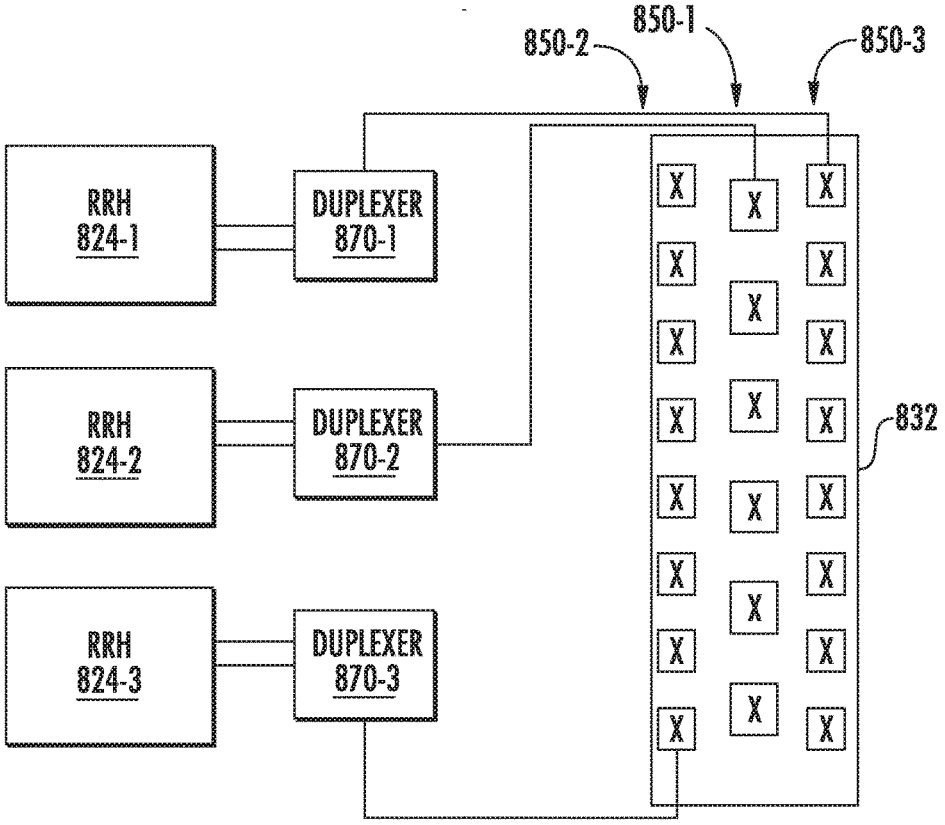
Figure 19C:
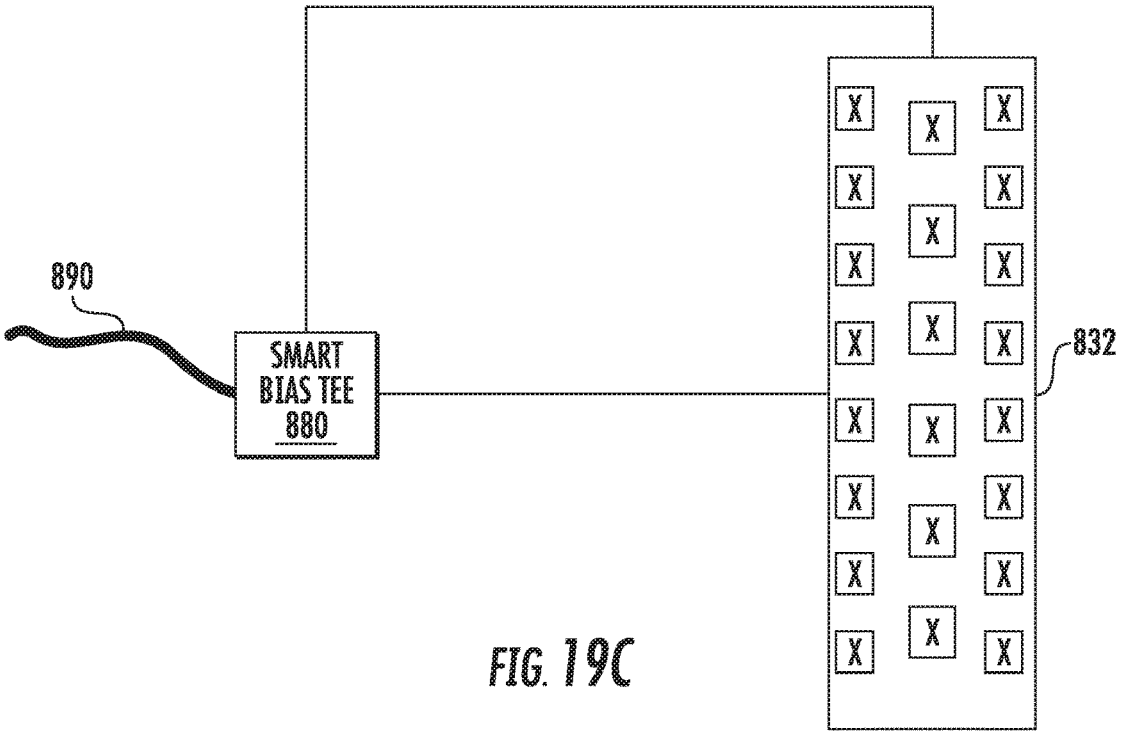

FIG. 19A-19C are schematic block diagrams that illustrate several types of filters that may be included on the antenna tower 830 of the cellular base station 810 of FIG. 18. As noted above, base station antenna 832 may support several different types of cellular service. As shown in FIG. 19A, the base station antenna 832 has three linear arrays 850-1, 850-2, 850-3 of radiating elements 852. Linear array 850-1 is an array of so-called "low-band" radiating elements that are designed to transmit and receive signals in lower frequency bands while linear arrays 850-2, 850-3 are arrays of so-called "high-band" radiating elements that are designed to transmit and receive signals in higher frequency bands. Three remote radio heads 824-1, 824-2, 824-3 are used to transmit and receive signals through the antenna 832. The first remote radio head 824-1 transmits and receives signals in a first frequency band via the low-band array 850-1 of radiating elements 852, the second remote radio head 824-2 transmits and receives signals in a second frequency band via the low-band array 850-1 of radiating elements 852, and the third remote radio head 824-3 transmits and receives signals in a third frequency band via the high-band arrays 850-2, 850-3 of radiating elements 852. A diplexer 860 is provided that connects the first remote radio head 824-1 and the second remote radio head 824-2 to the low-band array 850-1 of radiating elements 852.

A "diplexer" refers to a well-known type of three-port filter assembly that is used to connect first and second devices (here remote radio heads 824-1, 824-2) that operate in respective first and second, non-overlapping frequency bands to a common device (here linear array 850-1). The diplexer 860 isolates the RF transmission paths to the first and second remote radio heads 824-1, 824-2 from each other while allowing both RF transmission paths access to the radiating elements 852 of linear array 850-1. The diplexer 860 may be implemented as a pair of bandpass filters that are electrically connected to each other at a "common" port. Each bandpass filter may be designed to pass signals in a respective one of the first and second frequency bands and to not pass signals in the other of the respective frequency bands. The diplexer 860 may be implemented as a pair of bandpass filters according to embodiments of the present invention that share a common port.

In addition to diplexers various other filters are routinely used in cellular applications. For example, duplexers are used on most if not all cellular base station antennas to allow the transmit and receive port of each radio (e.g., remote radio head 824) to share the same radiating elements. A duplexer is a three-port filter that is similar to a diplexer, except that the transmit and receive frequency ranges are typically located closer together than the frequency bands for two different cellular services, and hence duplexers typically are more expensive, higher performance devices that can provide high amounts of isolation between closely separated frequency bands. Typically, duplexers are provided within the antennas 832, although they need not be. As shown in FIG. 19B, the filters according to embodiments of the present invention may be used to implement duplexers 870 for cellular base stations.

Another type of filter used in cellular base stations is a smart-bias tee. Smart bias tees are most typically used in base stations where the radios are located at the bottom of the antenna tower and the RF signals from the radios are carried to the antennas over an RF trunk cable. As shown in FIG. 19C, a trunk cable 890 may be used to carry both the RF signals and low frequency control signals and/or DC power signals up an antenna tower to an antenna 832. The trunk cable 890 may be connected to a smart bias tee 880. The smart bias tee 880 may include filters that separate the DC power and low frequency control signals from the RF signals. A first output of the smart bias tee 880 provides the DC power and low frequency control signals to a control/power port on the antenna 832, and a second output of the smart bias tee 880 provides the RF signals to an RF port of the antenna 832.

Pursuant to still further embodiments of the present invention, the above-described filters may be implemented as modular filters that can be fabricated from a plurality of building block units. For example, instead of having a one piece tubular metallic housing that includes a plurality of resonators therein, the filter may instead be formed from a plurality of resonator rings, where each resonator ring may include a resonator and a portion of the tubular metallic housing. The resonator rings may be connected to each other using threaded coupling rings. Input and output connector plates may also be provided that may likewise be connected to the resonator rings using I/O coupling rings. The filter may be fabricated by connecting ("stacking") the desired number and types of resonator rings and connector plates.

Figure 20:
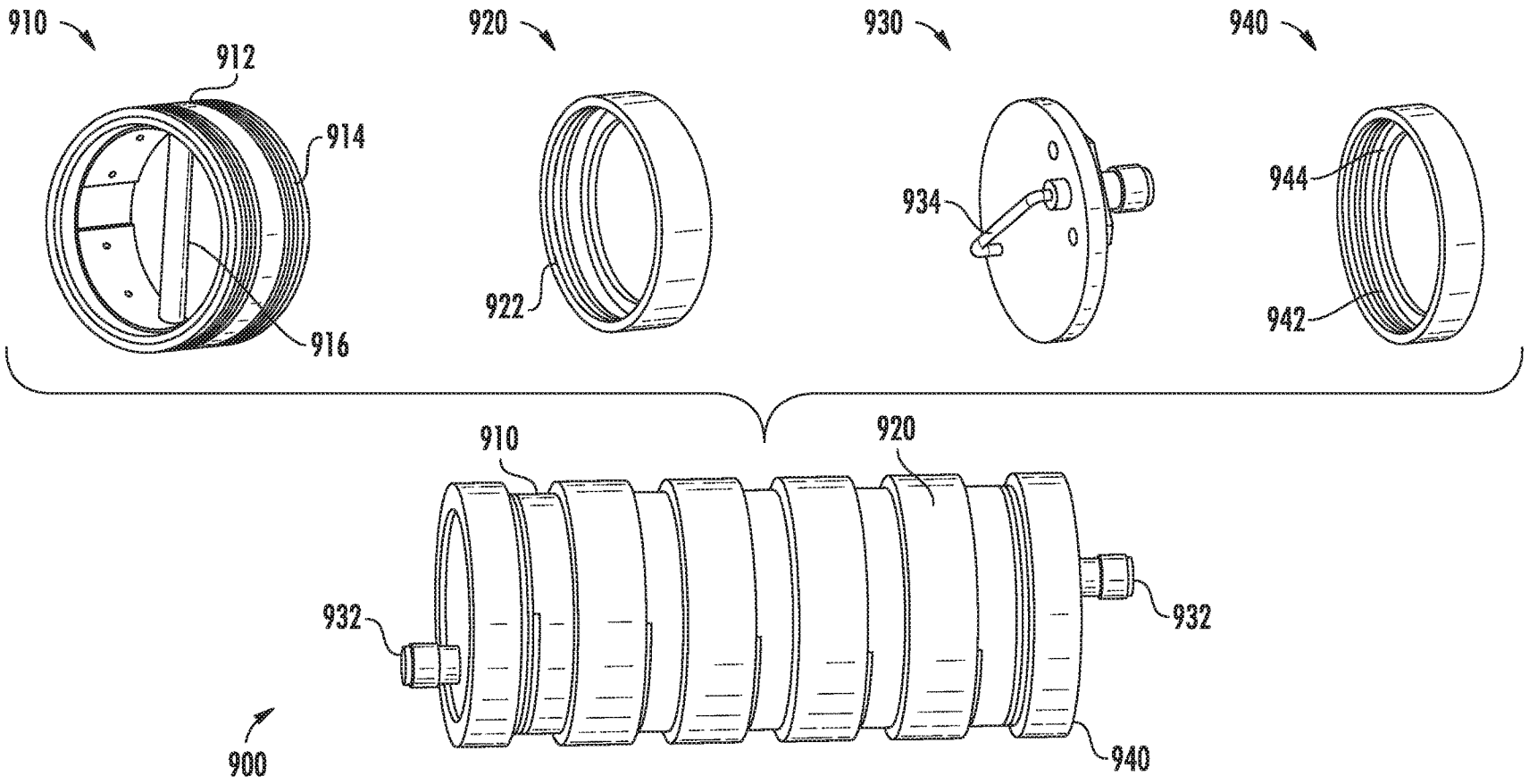
FIG. 20 is a perspective view of a modular filter according to embodiments of the present invention.

FIG. 20 is a perspective view of one such modular filter 900. FIG. 20 also illustrates example implementations of the basic building blocks of the filter 900. As shown in FIG. 20, the filter 900 is formed from a plurality of resonator rings 910, coupling rings 920, connector plates 930 and I/O coupling rings 940. Each resonator ring 910 may include a metallic ring 912 that has a resonator 916 installed in the interior thereof. The metallic ring 912 may be externally threaded with two sets of threads 914. The resonator 916 may be identical to any of the resonators according to embodiments of the present invention that are discussed herein, and may be attached in the same manner that the above-described resonators are attached to (or otherwise mounted within) the above-discussed one-piece tubular metallic housings according to embodiments of the present invention. Additional example resonators that may be implemented in the resonator rings 900 are discussed below with reference to FIGS. 21A-21D.

The coupling rings 920 may be metallic rings having internal threads 922. It will be appreciated that the threads 914, 922 on the resonator rings 910 and the coupling rings 920 may be reversed in other embodiments, with the resonator rings 910 having internal threads and the coupling rings 920 having external threads, or the resonator rings 910 and the coupling rings 920 each having one internal thread and one external thread. It will also be appreciated that resonator rings 910 and/or coupling rings 920 may be provided that have different longitudinal lengths so as to allow a modular mechanism to change the distance between adjacent resonators 916 when fabricating a modular filter according to embodiments of the present invention from basic building block units such as the building block units illustrated in FIG. 20. It will also be appreciated that some resonator rings 910 may not have a resonator 916 therein and may provide another way of modifying the spacing between adjacent resonators 916.

A connector plate 930 may be mounted on either end of the modular filter 900. The connector plate 930 may include a connector 932 for coupling to an external transmission line such as a cable having a mating connector thereon (not shown). The connector plate 930 may further include a coupling loop 934. With respect to the input to the modular filter 900 (e.g., the connector 932 on the left hand side of FIG. 20), the coupling loop 934 acts as an input coupling loop that transfers electromagnetic energy (i.e., an RF signal) that is input at connector 932 to an adjacent resonator 916 within modular filter 900. With respect to the output of to the modular filter 900 (e.g., the connector 932 on the right hand side of FIG. 20), the coupling loop 934 acts as an output coupling loop that transfers electromagnetic energy from a resonator 916 adjacent the output of the filter 900 to the output connector 932. The coupling loops 934 provide a convenient way for tuning the amount of energy coupled from resonators 916 that are adjacent and that are not adjacent to the coupling loop 934 simply by rotation of the orientation of the coupling loop 934 in order to tune the response of the filter 900. It will be appreciated that the coupling loops 934 are simply one example embodiment of a mechanism for coupling an RF signal between the input/output connectors 932 and the internal components of the filter 900. The coupling between the connectors 932 and the resonators 916 may be capacitive, inductive and/or galvanic.

The I/O coupling rings 940 may be metallic rings that are similar to the coupling rings 920, except that (a) the I/O coupling rings 940 may only have one set of internal threads 942 as opposed to two sets and (b) the I/O coupling ring 940 further includes a lip 944 that holds the connector plate 930 in place. It will be appreciated that the threads 914, 942 on the resonator rings 910 and the I/O coupling rings 940 may be reversed in other embodiments, with the resonator rings 910 having internal threads and the I/O coupling rings 940 having external threads.

The modular filter 900 is a bandpass filter and hence it does not have a transmission line. In other embodiments, modular filters such as, for example, band stop filters, may be provided that include a transmission line. The transmission line may be implemented in a manner similar to that described above with respect to non-modular embodiments of the present invention. For example, in the embodiment of FIGS. 8A-8K above, a transmission line 240 is provided that is mounted on a tubular dielectric frame 230. The modular filter 900 of FIG. 20 may be modified so that each resonator ring 910 includes a transmission line segment (not shown) that is mounted on a tubular dielectric frame that is mounted within the interior of the resonator ring 910, internal to the arms of the resonators 916. The transmission line may be capacitively coupled to the arms of the resonator 916. Each transmission line segment may be capacitively coupled to a transmission line segment in an adjacent resonator ring 910 to form a transmission line through the filter to provide, for example, a band stop modular filter.

Figure 21A:
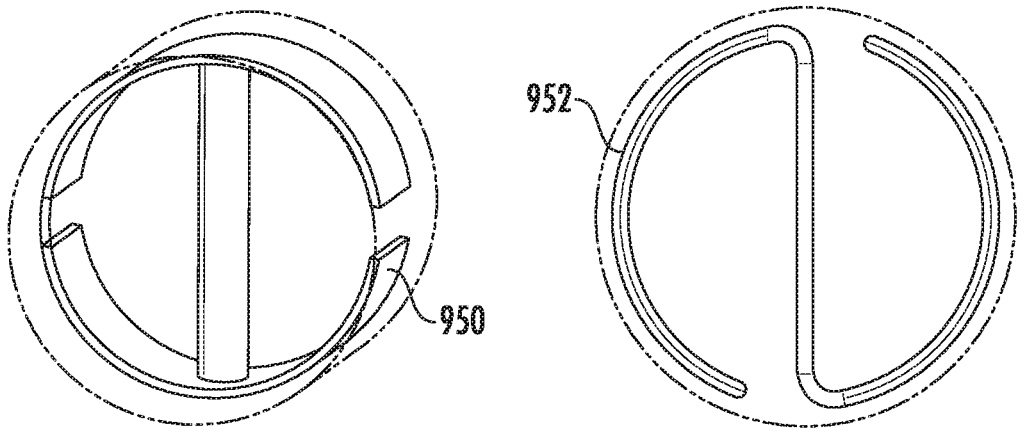
FIGS. 21A-21D are schematic diagrams illustrating a variety of different resonator designs that may be used in the modular filters according to embodiments of the present invention.
Figure 21B:
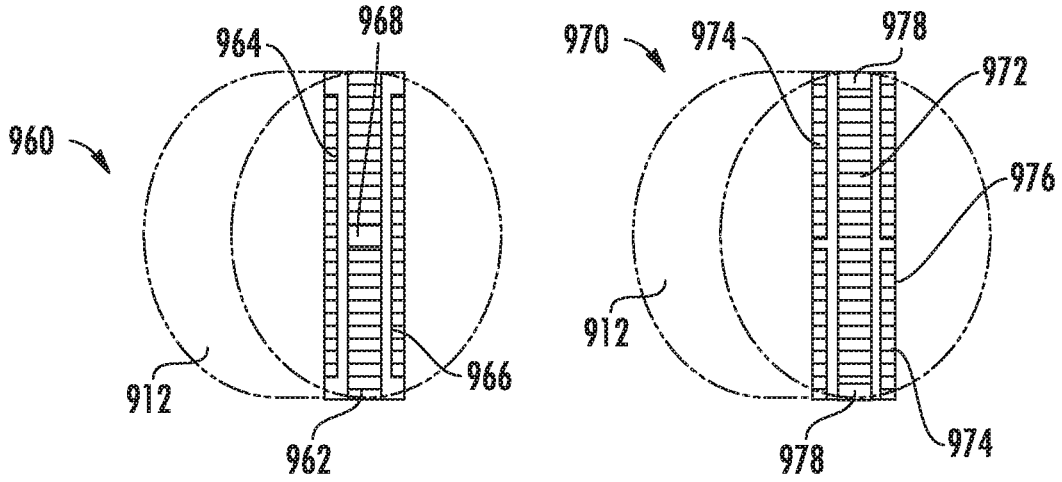

FIGS. 21A-21D illustrate a variety of different resonators that may be used in the resonator rings 910 according to embodiments of the present invention. As shown in FIGS. 21A-21D, the various resonators may have the same diameter so that resonator rings 910 including the various different types of resonators may be mixed and matched to provide filters having a wide variety of different responses at different frequencies. For example, FIG. 21A shows two different implementations for λ/2 floating resonators 950, 952, each of which have been discussed above. In FIG. 20, the resonators rings 910 have resonators 916 that have the design of resonator 950 of FIG. 20, but it will be appreciated that resonators 952 could alternatively be used, or any other appropriate for λ/2 floating resonator, FIG. 21B illustrates cross-sections of two λ/2 "interdigital" resonators 960, 970 that may be used in other embodiments to implement the resonators 916. The interdigital resonators 960, 970 are coaxial resonators that have overlapping surfaces to provide large amounts of coupling. As shown in FIG. 21B, the λ/2 interdigital resonator 960 is disposed within the ring 912 of a resonator ring 910. The resonator 960 includes a pair of inner conductors 962 and an outer conductor 964 that are separated by an annular insulating spacer 966. The inner conductors 962 are separated from each other by another spacer 968. One end of each inner conductor 962 is connected to the resonator ring 912, while the outer conductor 964 is spaced apart from the resonator ring 912 by the enlarged ends of the spacer 966. The λ/2 interdigital resonator 970 is similar to resonator 960, except that the resonator 970 includes a pair of annular outer conductors 974 and a single inner conductor 972. A spacer 976 separates the outer conductors 974 from the inner conductor 972. A pair of spacers 978 space the inner conductor 972 apart from the resonator ring 912. One end of each outer conductor 974 is connected to the resonator ring 912, while the inner conductor 972 does not galvanically connect to the resonator ring 912. Note that in each λ/2 interdigital resonator 960, 970 one of the conductors (inner or outer) is connected to the resonator ring 912 at each end while the other conductor is isolated from the resonator ring 912.

Figure 21C:
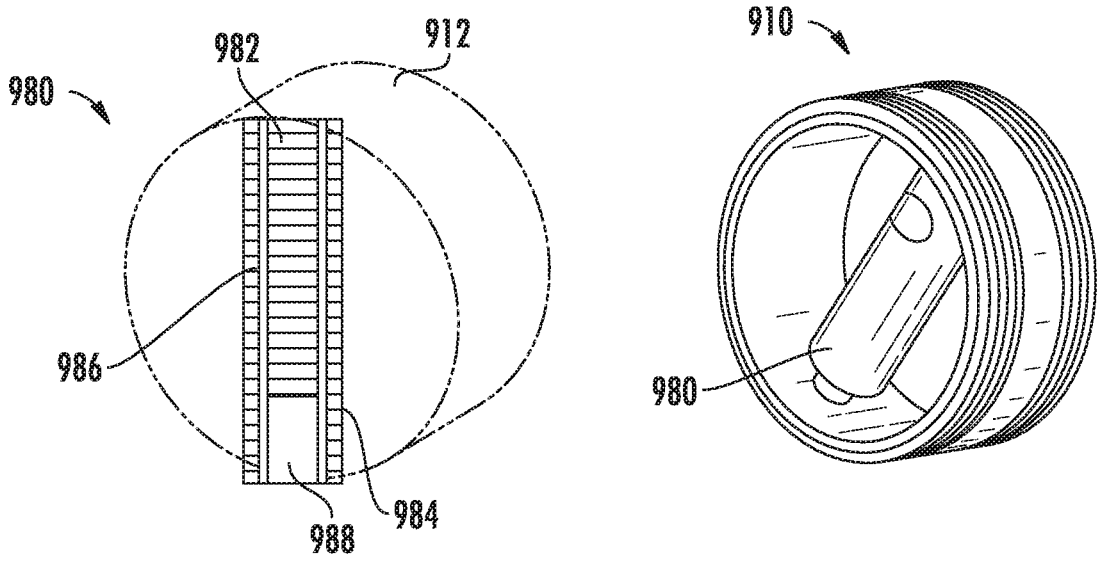

FIG. 21C illustrates a λ/4 interdigital resonator 980 that may be used in other embodiments. In particular, FIG. 21C includes a cross-sectional view of the interdigital resonator 980 as well as a perspective view of a resonator ring 910 that includes the λ/4 interdigital resonator 980. The interdigital resonator 980 is also a coaxial resonator. As shown in FIG. 21C, the λ/4 interdigital resonator 980 is disposed within the ring 912 of a resonator ring 910. The resonator 980 includes an inner conductor 982 and an outer conductor 984 that are separated by an annular insulating spacer 986. The inner conductor 982 may be connected to the top portion of the resonator ring 912, while the outer conductor 984 may be connected to the bottom side of the resonator ring 912.

Figure 21D:
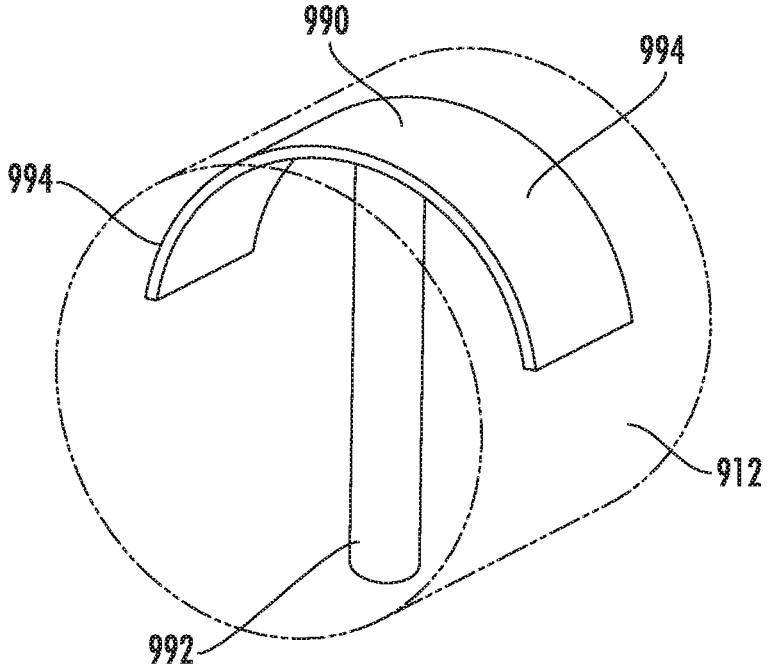

FIG. 21D illustrates a λ/4 mushroom type resonator 990 that may be used in still other embodiments. As shown in FIG. 21D, the resonator 990 includes a stalk 992 that is galvanically connected to the resonator ring 912 and a pair of arms 994 extending from one end of the stalk 992 that are capacitively coupled to the resonator ring 912.

Thus, FIGS. 21A-21D show that a wide variety of different resonators may be used in the modular filters according to embodiments of the present invention. It will also be appreciated that these resonators may similarly be used in the non-modular embodiments of the present invention. Different resonator types may be mixed in the same filter in some embodiments to provide a more flexible filter response.

Figure 22:
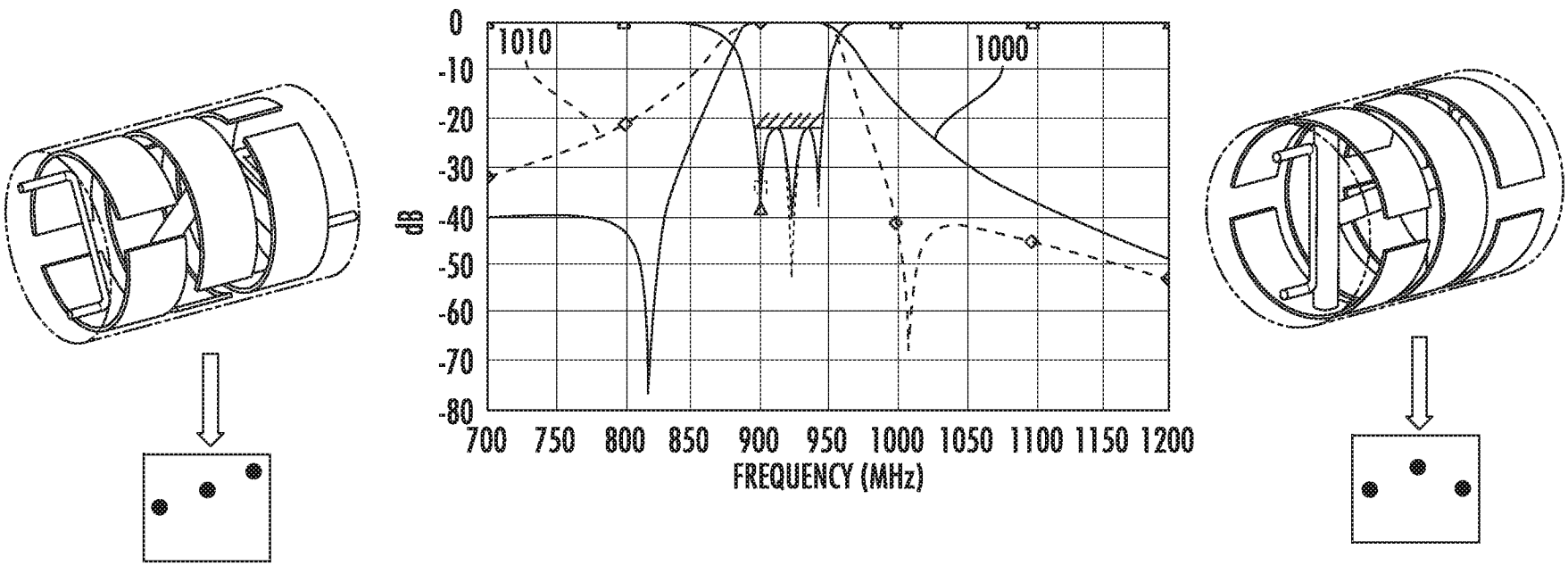
FIG. 22 is a schematic diagram that illustrates how resonators may be designed to provide transmission zeros in the response of a bandpass modular filter according to embodiments of the present invention.

FIG. 22 is a schematic diagram that illustrates how sets of three resonators may be designed to provide transmission zeros in the response of a bandpass modular filter according to embodiments of the present invention. In particular, a first curve 1000 in FIG. 22 shows how three resonators oriented in a first "topology scheme" may be used to provide a transmission zero below the passband of the filter, and a second curve 1010 in FIG. 22 shows how three resonators oriented in a second topology scheme may be used to provide a transmission zero above the passband of the filter. The position of the transmission zeros in the filter response graph of FIG. 22 may be controlled by the mutual distance between resonators, with the closer the resonators the close the transmission zero to the passband. In FIG. 22, the "topology scheme" shows the relative locations of the stalks of the resonators included in each resonator ring when viewed from above.

The filters according to embodiments of the present invention may provide a number of advantages over conventional filter assemblies. As discussed above, the filters may be smaller and lighter than conventional filters. This may be a significant advantage with respect to tower mounted equipment, as it is typically desirable to reduce or minimize both the weight (because of tower load requirements) and size (because of wind loading and local zoning ordinances) of tower mounted equipment. The filters may also be easier and cheaper to manufacture than conventional filters.

Additionally, as noted above, the filters according to embodiments of the present invention may be integrated into cables (e.g., coaxial cables) or implemented as in-line components that effectively comprise an extension on the end of a cable. In these embodiments the diameter (or other cross-section) of the tubular filter may be on the order of the diameter of the cable in some cases. For example, for a 1 GHz filter the diameter of the tubular filter may be slightly larger than the diameter of the cable. By way of example, a filter with a passband somewhere in the 700-1000 MHz it frequency range might have a diameter on the order of 1 inch or a little more. A 2 GHz filter may have a diameter that is about the same as the diameter of the cable. Filters that operate at higher frequencies may have diameters that are smaller than the diameter of the cable. When implemented as an in-line filter, the filter may simply be mounted on a connector of the antenna or the radio so that the connection between the antenna and the radio comprises the combination of one cable and the filter. In such embodiments, the filter may have a male connector on one end and a female connector on the other end to facilitate this connection. In embodiments where the filter is integrated into the cable, the cable may have the same type of connector on each end thereof.

In many wireless applications, installers may impose a separate charge for each item of equipment mounted on an antenna tower or other structure. The tubular filters according to embodiments of the present invention may be integrated into, or hang in-line from, cabling connections. As such, the filters may be implemented outside of the antenna without requiring separate mounting and without resulting in additional bulky and/or unsightly equipment boxes being mounted separate from the antennas on the tower.

While embodiments of the present invention have primarily been described above with reference to filters for cellular communications systems, it will be appreciated that the filters according to embodiments of the present invention may be used in a wide range of RF communications systems and that the invention is not limited in any way to cellular applications. Likewise, it will be appreciated that the filters also have application for communications systems other than RF communications systems. As an example, the filters disclosed herein may also be designed for use in microwave communications systems.

The present invention has been described above with reference to the accompanying drawings, in which certain embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. An in-line filter, comprising:

a tubular metallic housing defining a single inner cavity that extends along a longitudinal axis; and a plurality of resonators that are spaced apart along the longitudinal axis within the single inner cavity, each resonator having a conductive stalk oriented transverse to the longitudinal axis, wherein the stalks of first and second resonators of the plurality of resonators that are adjacent each other are rotated to have different angular orientations about the longitudinal axis, wherein each of the plurality of resonators includes: a first capacitive loading element that extends from a first end portion of the stalk of the respective resonator, wherein the first capacitive loading element comprises a first arc-shaped arm, and a second arc-shaped arm that extends from a second end portion of the stalk that is opposite the first end portion.

2. The in-line filter of claim 1, wherein each of the plurality of resonators further includes a plurality of spacers that space the corresponding first and second arc-shaped arms apart from an inner surface of the tubular metallic housing.

3. The in-line filter of claim 2, wherein the plurality of resonators further include a third resonator; the second resonator is adjacent the first resonator, and the third resonator is adjacent the second resonator, wherein the stalks of the first and third resonators have substantially the same angular orientation.

4. The in-line filter of claim 3, wherein the stalk of the second resonator is rotated to have an angular orientation that is offset by approximately ninety degrees from the angular orientations of the stalks of the first and third resonators.

5. The in-line filter of claim 1, further comprising a transmission line that extends between at least two of the plurality of resonators, each of the at least two resonators are capacitively coupled to the transmission line.

6. The in-line filter of claim 1, wherein the tubular metallic housing has a substantially circular cross-section.

7. The in-line filter of claim 6, wherein the filter comprises a bandpass filter, and the filter does not include any distributed coupling elements for coupling between non-adjacent resonators.

8. The in-line filter of claim 1, wherein the tubular metallic housing is grounded, and wherein each of the plurality of resonators is electrically floating.

9. The in-line filter of claim 1, wherein the first arc-shaped arm of each of the plurality of resonators is only galvanically connected to the second arc-shaped arm of the respective resonator through the stalk of the respective resonator.

10. An in-line filter, comprising:

a tubular metallic housing defining a single inner cavity that extends along a longitudinal axis:

a plurality of resonators that are spaced apart along the longitudinal axis within the single inner cavity, each resonator having a conductive stalk oriented transverse to the longitudinal axis; and a tubular dielectric frame within the tubular metallic housing and a transmission line that extends between at least two of the plurality of resonators, each of the at least two resonators is coupled to the transmission line, wherein the transmission line is on an outer surface of the tubular dielectric frame.

11. The in-line filter of claim 10, wherein each of the plurality of resonators includes a first arc-shaped capacitive loading element that extends from a first end portion of the stalk of the corresponding resonator, and wherein the stalks of the plurality resonators extend through the tubular dielectric frame and the first arc-shaped capacitive loading elements are on the outer surface of the tubular dielectric frame, with the transmission line positioned between each first arc-shaped capacitive loading element and the tubular dielectric frame.

12. The in-line filter of claim 11, further comprising a tuning element that is configured to bend the first arc-shaped capacitive loading element of one of the plurality of resonators closer to the transmission line.

13. A filter comprising an electrically grounded tubular metallic housing defining a single inner cavity;

a plurality of electrically floating resonators that are disposed in a spaced-apart arrangement within the single inner cavity; and a transmission line that extends from an input to an output of the filter, the transmission line capacitively coupled to at least one of the resonators, wherein each resonator includes a stalk and a first capacitive loading element that extends from a first end portion of the stalk.

14. The filter of claim 13, wherein the transmission line is capacitively coupled to the first capacitive loading element of each of the resonators.

15. The filter of claim 13, wherein each first capacitive loading element comprises a first arc-shaped arm.

16. The filter of claim 15, wherein each resonator comprises a second arc-shaped arm that extends from a second end portion of the stalk that is opposite the first end portion.

17. The filter of claim 16, further comprising a tubular dielectric frame within the tubular metallic housing, wherein the transmission line is on an outer surface of the tubular dielectric frame and wherein the stalk of each resonator extends through the tubular dielectric frame and the first and second arc-shaped arms are on the outer surface of the tubular dielectric frame, with the transmission line positioned between each first arc-shaped arm and the tubular dielectric frame.

18. The filter of claim 16, wherein each resonator further includes a plurality of spacers that space the corresponding first and second arc-shaped arms apart from an inner surface of the tubular metallic housing.

19. The filter of claim 13, wherein the resonators include at least a first resonator, a second resonator that is adjacent the first resonator and a third resonator that is adjacent the second resonator, wherein the stalks of the first and second resonators are rotated to have different angular orientations.

20. The filter of claim 19, wherein the first and third resonators have substantially the same angular orientations.

* * * * *